US010857432B2

(12) United States Patent
Mardinly, Sr. et al.

(10) Patent No.: US 10,857,432 B2
(45) Date of Patent: Dec. 8, 2020

(54) PUTTER HEAD

(71) Applicant: Neo-Sync LLC, Havertown, PA (US)

(72) Inventors: Michael G. Mardinly, Sr., Drexel Hill, PA (US); Thomas V. Falone, Mickelton, NJ (US)

(73) Assignee: Neo-Sync LLC, Havertown, PA (US)

( * ) Notice: Subject to any disclaimer, the term of this patent is extended or adjusted under 35 U.S.C. 154(b) by 0 days.

(21) Appl. No.: 15/979,769

(22) Filed: May 15, 2018

(65) Prior Publication Data

US 2018/0326266 A1 Nov. 15, 2018

Related U.S. Application Data

(60) Provisional application No. 62/506,375, filed on May 15, 2017.

(51) Int. Cl.

| | |
|---|---|
| ***A63B 53/04*** | (2015.01) |
| ***A63B 60/54*** | (2015.01) |
| *A63B 102/32* | (2015.01) |

(52) U.S. Cl.

CPC ..... *A63B 53/0487* (2013.01); *A63B 53/04* (2013.01); *A63B 60/54* (2015.10); *A63B 53/042* (2020.08); *A63B 53/0408* (2020.08); *A63B 2102/32* (2015.10); *A63B 2209/08* (2013.01)

(58) Field of Classification Search

USPC ..... 473/324–350

See application file for complete search history.

(56) References Cited

U.S. PATENT DOCUMENTS

| | | | | | |
|---|---|---|---|---|---|
| 925,389 | A | * | 6/1909 | Royce | A63B 53/04 473/329 |
| 1,627,848 | A | * | 5/1927 | Hubbard | A63B 53/04 473/343 |
| 1,678,001 | A | * | 7/1928 | Brace | H01F 1/04 420/36 |
| 2,156,019 | A | * | 4/1939 | Jonas | C21D 1/78 420/80 |
| 2,343,481 | A | * | 3/1944 | Scott | H01F 1/04 148/101 |
| 2,383,969 | A | * | 9/1945 | Howerton | H01F 1/04 420/107 |
| RE28,878 | E | * | 6/1976 | Korchynsky | C22C 38/001 148/331 |
| 4,039,012 | A | * | 8/1977 | Cook | B25D 1/02 473/333 |
| 4,339,339 | A | * | 7/1982 | Maciejewski | C10M 169/00 252/75 |

(Continued)

FOREIGN PATENT DOCUMENTS

| | | | | |
|---|---|---|---|---|
| GB | 2451317 | A * | 1/2009 | A63B 53/047 |
| JP | 05277212 | A * | 10/1993 | |

(Continued)

*Primary Examiner* — Alvin A Hunter

(74) *Attorney, Agent, or Firm* — BakerHostetler

(57) ABSTRACT

A golf putter head includes a body having an external surface, an internal surface, and a cavity defined by the internal surface, the external surface having a front side configured to contact a golf ball and a top side configured to receive a shaft; and an insert configured to be disposed within the cavity of the body, the insert having a first material comprising an elastomer and a shock absorbing element at least partially encapsulated within the first material.

20 Claims, 29 Drawing Sheets

(56) References Cited

U.S. PATENT DOCUMENTS 4,824,110 A * 4/1989 Kobayashi ..... A63B 53/04 473/332
4,961,576 A * 10/1990 Meredith ..... A63B 53/12 473/323
5,039,098 A * 8/1991 Pelz ..... A63B 53/02 473/306
5,195,747 A * 3/1993 Choy ..... A63B 21/0602 473/333
5,346,219 A * 9/1994 Pehoski ..... A63B 53/0487 473/325
5,366,222 A * 11/1994 Lee ..... A63B 53/08 473/333
5,529,543 A * 6/1996 Beaumont, Sr. ..... A63B 53/04 473/290
5,613,916 A * 3/1997 Sommer ..... A63B 60/00 473/332
5,686,158 A * 11/1997 Gibbon ..... A63B 53/14 428/36.92
5,766,092 A * 6/1998 Mimeur ..... A63B 53/04 473/329
5,766,093 A * 6/1998 Rohrer ..... A63B 53/0487 473/329
5,776,009 A * 7/1998 McAtee ..... A63B 53/04 473/333
5,820,817 A * 10/1998 Angeliu ..... C22C 38/002 420/40
6,001,030 A * 12/1999 Delaney ..... A63B 53/0487 473/329
6,159,109 A 12/2000 Langslet
6,231,452 B1 * 5/2001 Novosel, Sr. ..... A63B 53/007 124/3
6,302,807 B1 * 10/2001 Rohrer ..... A63B 53/0487 473/329
6,354,956 B1 * 3/2002 Doong ..... A63B 53/0466 473/219
6,431,997 B1 * 8/2002 Rohrer ..... A63B 53/04 473/324
6,450,903 B1 * 9/2002 Tate ..... A63B 69/3676 473/236
6,575,854 B1 * 6/2003 Yang ..... A63B 53/00 473/519
6,595,867 B2 7/2003 Sosin
6,746,344 B1 * 6/2004 Long ..... A63B 53/0487 473/332
6,921,343 B2 * 7/2005 Solheim ..... A63B 53/04 473/329
7,037,213 B2 * 5/2006 Otoguro ..... A63B 53/04 473/333
7,070,513 B2 * 7/2006 Takeda ..... A63B 53/04 473/329
7,070,514 B1 * 7/2006 Borunda ..... A63B 53/0466 473/333
7,156,752 B1 * 1/2007 Bennett ..... A63B 53/02 473/334
7,192,362 B2 * 3/2007 Gilbert ..... A63B 53/047 473/291
7,192,365 B2 * 3/2007 Souza ..... A63B 53/0487 473/329
7,273,420 B2 * 9/2007 Wright ..... A63B 53/0487 473/329
7,393,287 B2 * 7/2008 Huang ..... A63B 53/04 473/329
7,448,959 B2 * 11/2008 Blankenship ..... A63B 53/04 473/329
7,500,923 B2 * 3/2009 Tateno ..... A63B 53/0487 473/329
7,625,298 B2 * 12/2009 Bennett ..... A63B 53/02 473/334
7,682,265 B2 * 3/2010 VanDelden ..... A63B 24/0021 473/351
7,713,139 B1 * 5/2010 Stites ..... A63B 53/0487 473/329
7,731,599 B1 6/2010 Caserta
7,976,407 B2 * 7/2011 VanDelden ..... A63B 24/0021 473/354
8,382,609 B2 * 2/2013 Yokota ..... A63B 53/0466 473/342
8,480,513 B2 * 7/2013 Kuan ..... A63B 53/0487 473/329
8,617,006 B2 * 12/2013 VanDelden ..... A63B 24/0021 473/409
8,790,192 B2 * 7/2014 Narita ..... A63B 53/0487 473/329
9,033,818 B2 * 5/2015 Myrhum ..... A63B 53/0466 473/329
9,533,202 B2 * 1/2017 Blevins ..... G06F 16/51
9,700,764 B2 * 7/2017 Carter ..... A63B 53/0466
10,434,389 B2 * 10/2019 Morales ..... A63B 53/0466
2005/0009623 A1 * 1/2005 Dickinson ..... A63B 53/04 473/329
2017/0028272 A1 * 2/2017 McCormack ..... A63B 53/0466

FOREIGN PATENT DOCUMENTS

JP 2003180888 A * 7/2003
JP 2007117634 A * 5/2007 ..... A63B 53/0487
WO WO 2004022172 A1 * 3/2004 ..... A63B 53/047

* cited by examiner

SECTION A-A

SECTION B-B

SECTION B–B

SECTION A-A

SECTION B-B

SECTION A-A

SECTION B-B

SECTION A-A

SECTION B-B

PUTTER HEAD

CROSS REFERENCE TO RELATED APPLICATIONS

This application claims the benefit of U.S. Provisional Application No. 62/506,375 filed May 15, 2017, the entirety of which is incorporated herein for any and all purposes.

TECHNICAL FIELD

The present disclosure relates generally to a golf club, and specifically to golf club putters and gold club putter heads.

BACKGROUND

In golf, putting is the process of making short, low-speed strokes to hit a golf ball. Unlike other strokes (for example, driving), putting is intended to move the ball by rolling more slowly along the ground rather than hitting it long distances through the air. Many different types of golf putters exist. Putters may have various specifications, such as different head shapes and sizes, balance distribution, overall weight, striking surface materials, inserts, and shaft placement. By definition, a putter is a club with a loft not exceeding ten degrees designed primarily for use on the putting green. Some styles and specifications have generally-accepted advantages and disadvantages, and often depend on golfing terrain, ball placement, and distance to the hole. However, many times the choice of style of a putter comes down to user preference.

SUMMARY

In one embodiment, a golf putter head includes a body having an external surface, an internal surface, and a cavity defined by the internal surface. The external surface has a front side configured to contact a golf ball and a top side configured to receive a shaft. The golf putter head further includes an insert configured to be disposed within the cavity of the body. The insert has a first material comprising an elastomer and a shock absorbing element at least partially encapsulated within the first material.

In another embodiment, a device for striking a ball includes a body having an external surface, an internal surface, and a receptacle configured to receive and fixedly secure a shaft. The external surface has a striking surface configured to contact the ball. The device further includes a cavity defined by the internal surface, the cavity having an opening extending through the body to the external surface, such that the opening is defined by the internal surface and the external surface. The device also includes a first material having an epoxy disposed within the cavity and a second material disposed within the cavity and at least partially within the first material. The device further includes a cover configured to sealably engage the body such that the opening in the cavity is closed.

In another embodiment, a method of manufacturing a golf club head includes positioning a golf club head body having a cavity therein such that at least a portion of the cavity is open and extends through the golf club head body, introducing into the cavity a first material, introducing into the cavity a second material that is different from the first material, such that the first material at least partially surrounds the second material, and sealing the cavity such that the first material and the second material are secured within the cavity.

BRIEF DESCRIPTION OF THE DRAWINGS

The present application is further understood when read in conjunction with the appended drawings. For the purpose of illustrating the subject matter, there are shown in the drawings exemplary embodiments of the subject matter; however, the presently disclosed subject matter is not limited to the specific methods, devices, and systems disclosed. Furthermore, the drawings are not necessarily drawn to scale. In the drawings.

and

Figure 16A:
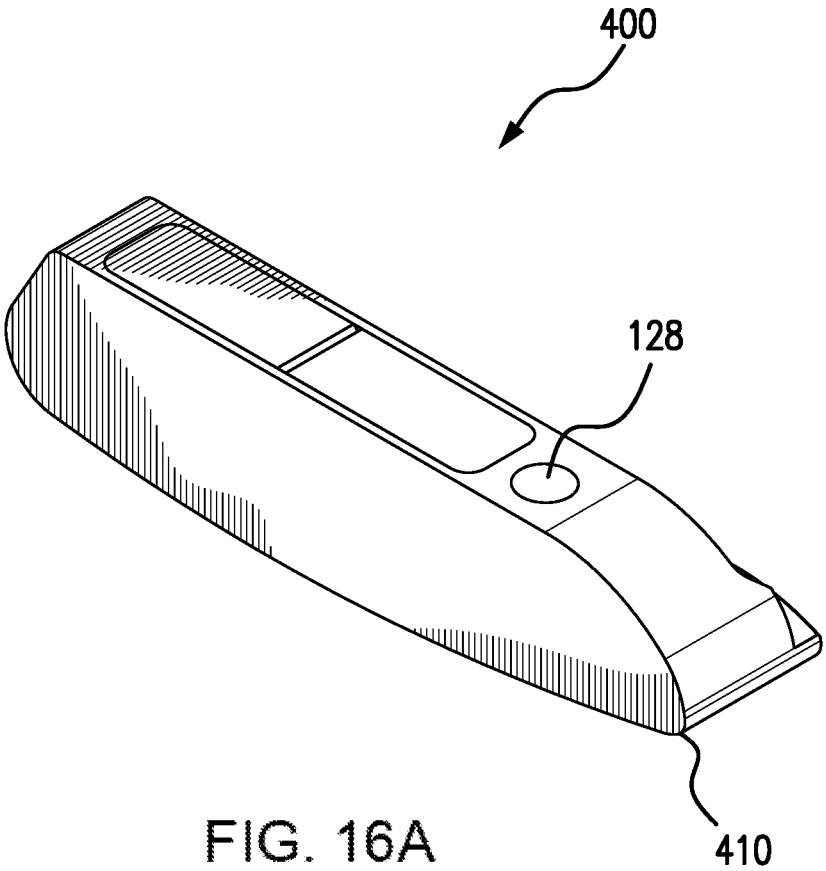
FIG. 16A illustrates a putter head according to another embodiment of the present disclosure.
Figure 16B:
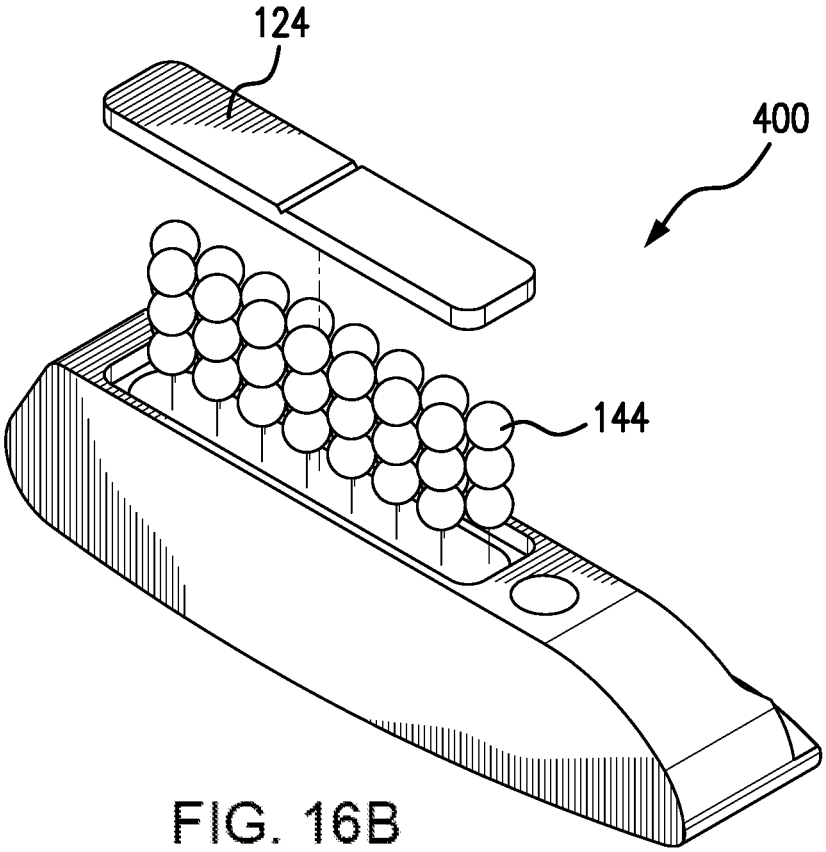
FIG. 16B illustrates an isometric exploded view of the putter head of FIG. 16A.
Figure 16C:
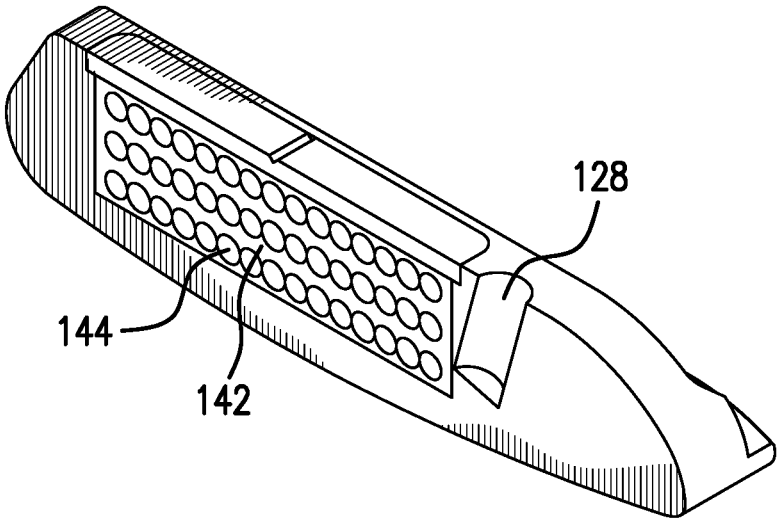
Figure 16D:
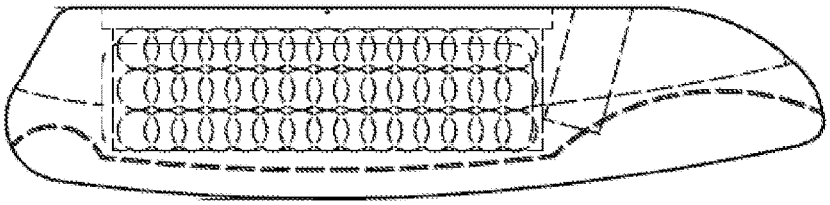
Figure 16E:
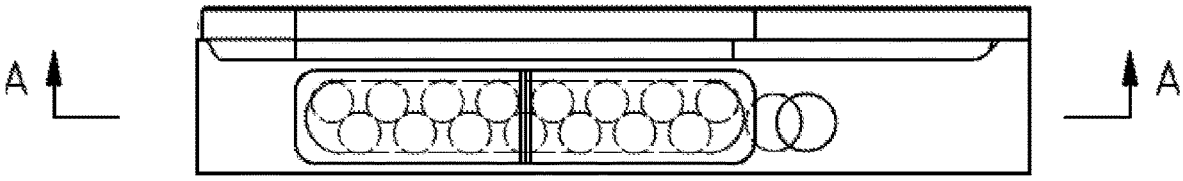
Figure 16F:
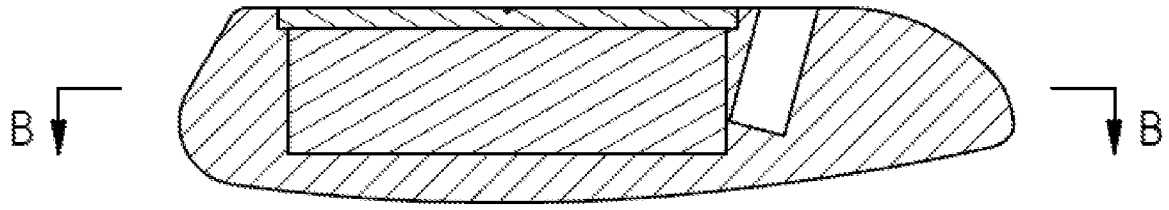
Figure 16G:
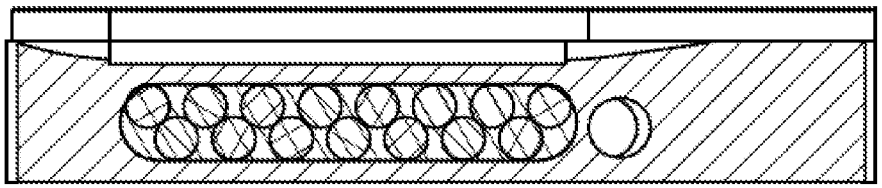
Figure 17A:
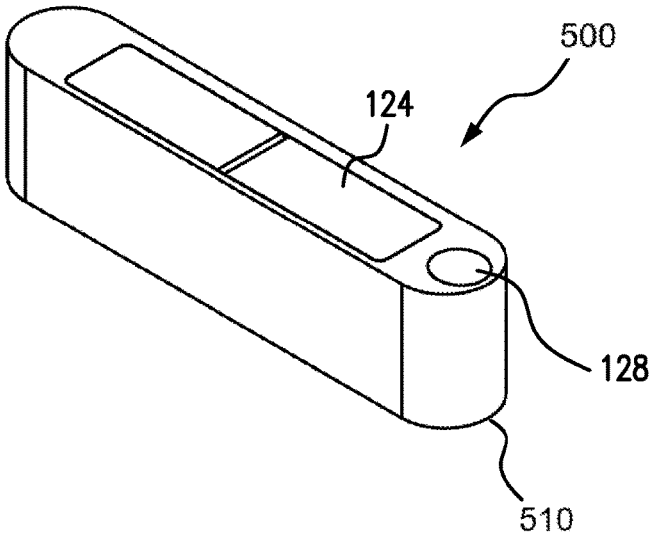
Figure 17B:
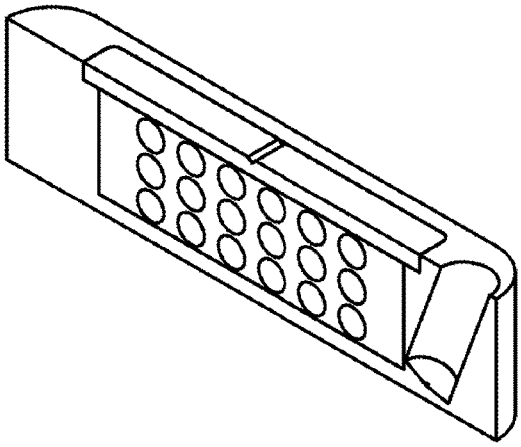
Figure 17C:
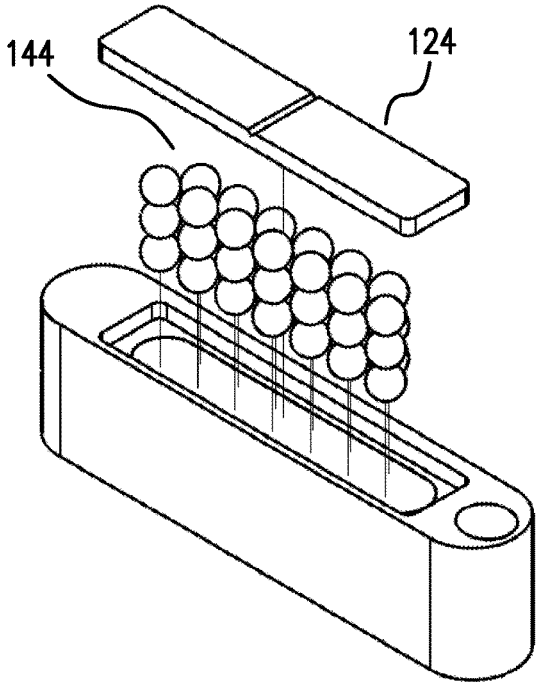
Figure 17D:
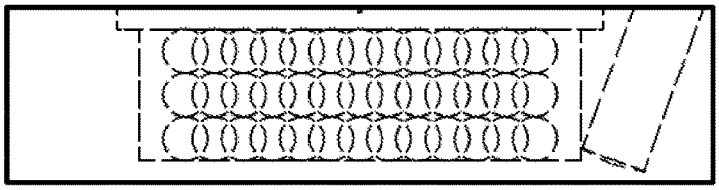
Figure 17E:
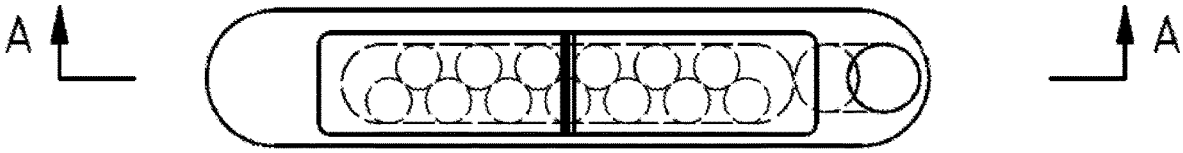
Figure 17F:
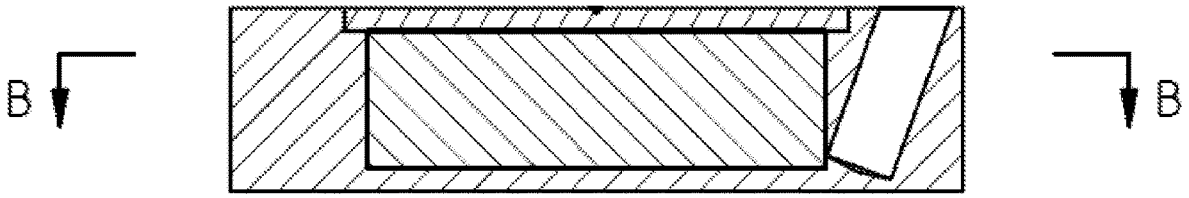
Figure 17G:
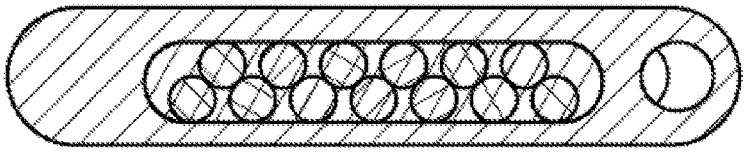

FIG. 16C illustrates an isometric cross-sectional view of the putter head of FIGS. 16A and 16B;

FIG. 16D illustrates a front perspective cross-sectional view of the putter head of FIGS. 16A-16C;

FIG. 16E illustrates a top perspective cross-sectional view of the putter head of FIGS. 16A-16D;

FIG. 16F illustrates a cross-sectional view of the putter head along plane A-A shown in FIG. 16E;

FIG. 16G illustrates a cross-sectional view of the putter head along plane B-B shown in FIG. 16F;

FIG. 17A illustrates an isometric view of a putter head according to another embodiment;

FIG. 17B illustrates an isometric cross-sectional view of the putter head of FIG. 17A;

FIG. 17C illustrates an isometric exploded view of the putter head of FIGS. 17A and 17B;

FIG. 17D illustrates a front perspective cross-sectional view of the putter head of FIGS. 17A-17C;

FIG. 17E illustrates a top perspective cross-sectional view of the putter head of FIGS. 17A-17D;

FIG. 17F illustrates a cross-sectional view of the putter head along plane A-A shown in FIG. 17E; and FIG. 17G illustrates a cross-sectional view of the putter head along plane B-B shown in FIG. 17F.

DETAILED DESCRIPTION OF ILLUSTRATIVE EMBODIMENTS

Aspects of the disclosure will now be described in detail with reference to the drawings, wherein like reference numbers refer to like elements throughout, unless specified otherwise. Certain terminology is used in the following description for convenience only and is not limiting.

The term "plurality," as used herein, means more than one. The singular forms "a," "an," and "the" include the plural reference, and reference to a particular numerical value includes at least that particular value, unless the context clearly indicates otherwise. Thus, for example, a reference to "a material" is a reference to at least one of such materials and equivalents thereof known to those skilled in the art, and so forth.

The transitional terms "comprising," "consisting essentially of" and "consisting" are intended to connote their generally in accepted meanings in the patent vernacular; that is, (i) "comprising," which is synonymous with "including," "containing," or "characterized by," is inclusive or open-ended and does not exclude additional, unrecited elements or method steps; (ii) "consisting of" excludes any element, step, or ingredient not specified in the claim; and (iii) "consisting essentially of" limits the scope of a claim to the specified materials or steps "and those that do not materially affect the basic and novel characteristic(s" of the claimed invention. Embodiments described in terms of the phrase "comprising" (or its equivalents), also provide, as embodiments, those which are independently described in terms of "consisting of" and "consisting essentially of."

The term "substantially centered" as used herein in reference to two elements with respect to each other includes the one element being close to, but not exactly, centered relative to the other element, as well as the one element being exactly centered relative to the other element.

When values are expressed as approximations by use of the antecedent "about," it will be understood that the particular value forms another embodiment. In general, use of the term "about" indicates approximations that can vary depending on the desired properties sought to be obtained by the disclosed subject matter and is to be interpreted in the specific context in which it is used, based on its function, and the person skilled in the art will be able to interpret it as such. In some cases, the number of significant figures used for a particular value may be one non-limiting method of determining the extent of the word "about." In other cases, the gradations used in a series of values may be used to determine the intended range available to the term "about" for each value. Where present, all ranges are inclusive and combinable. That is, reference to values stated in ranges includes each and every value within that range.

When a list is presented, unless stated otherwise, it is to be understood that each individual element of that list, and every combination of that list, is a separate embodiment. For example, a list of embodiments presented as "A, B, or C" is to be interpreted as including the embodiments, "A," "B," "C," "A or B," "A or C," "B or C," or "A, B, or C."

Throughout this specification, words are to be afforded their normal meaning as would be understood by those skilled in the relevant art. However, so as to avoid misunderstanding, the meanings of certain terms will be specifically defined or clarified.

Different golf strokes affect the ball in different ways, and putting has specific mechanics associated with it. When a ball is putted, it first skids a distance before it begins a pure roll. In some aspects, it may be advantages to have a minimum percentage of skid and maximum percentage of roll to control the direction of the putt and the distance that the ball travels.

Minimum skid may be obtained by striking the top of the ball with the bottom of the putter face. This situation gets the ball into pure roll quickly, but the impact imparts no loft to the putt. This may not always be advantageous. Such striking mechanics cause the ball to bounce because it is driven into the ground and not lifted slightly up and onto the grass. The final result is that direction and distance control is suboptimal. An alternative mechanism with similar disadvantages may include striking the ball at an angle of approximately zero degrees from the horizontal (0 degrees loft). A preferred method of putting is described herein, in which the ball has a minimal skid and maximum roll, resulting in better control for the ball travel distance and direction.

Multiple embodiments of a golf putter are described throughout this application. According to some embodiments, a golf putter head 100 may include a body 110 and an insert 140 insertable into the body 110. Referring to FIGS. 1-8, the body 110 has an outer surface 112, an inner surface 114, a cavity 130 defined by the inner surface 114, and an opening 132 fluidly connecting the outer surface 112 to the inner surface 114. As a person skilled in the art would appreciate, the body 110 may have various shapes and configurations that may be useful in the golfing discipline. In the embodiment shown in FIGS. 1-8, the body 110 has a front face 116, a top face 118, a bottom face 120 parallel to the top face 118, and a back face 122 that contacts the front face 116, the top face 118, and the bottom face 120.

In some embodiments, the body 110 may include a striking surface 126 configured to contact a golf ball (not shown). The striking surface 126 may be part of the integral body, or it may be a separate unit that fixedly secures to the body. The striking surface 126 may include structural features (not shown), such as dimples, ridges, notches, protrusions, or other structural elements useful in improving the mechanisms of striking a golf ball. Alternatively, the striking surface 126 may be devoid of any additional features and may be substantially the same as the outer surface 112 of the body.

In some embodiments, the striking surface 126 may be disposed on the body 110 such that it forms different angles relative to a reference point. The striking surface 126 may be manufactured to create various lie angles measured from the shaft (not shown) of the golf club to the playing surface (not shown). Additionally, the striking surface 126 may be manufactured to have various loft angles measured from the plane in which the striking surface lies and the playing surface. It will be understood that various lie and loft angle combinations may be used and that any particular lie or loft angle described herein is not meant to limit the disclosure.

Figure 14:
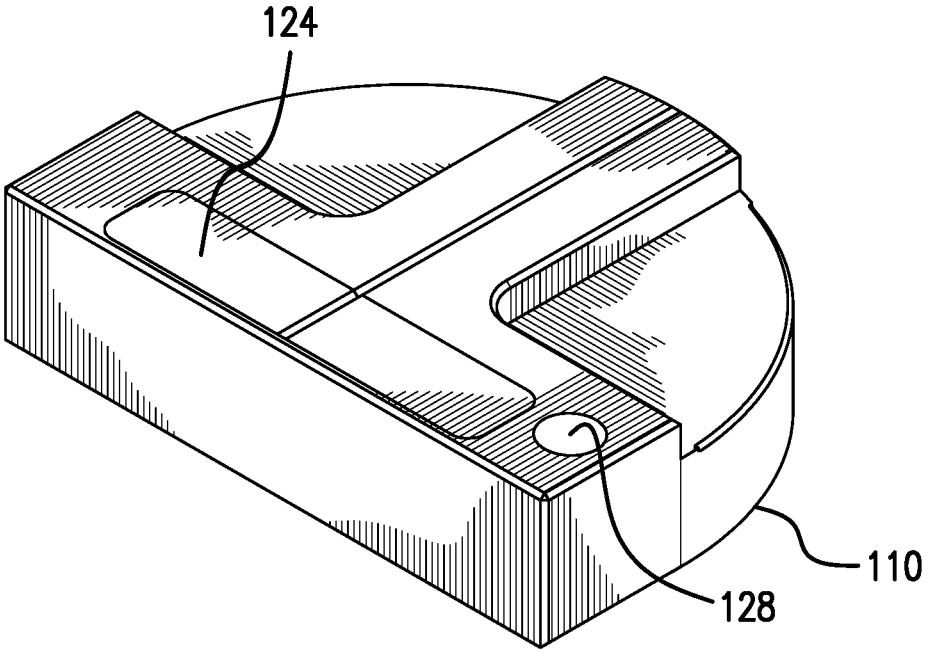
FIG. 14 illustrates a putter head according to another embodiment of the present disclosure.
Figure 15A:
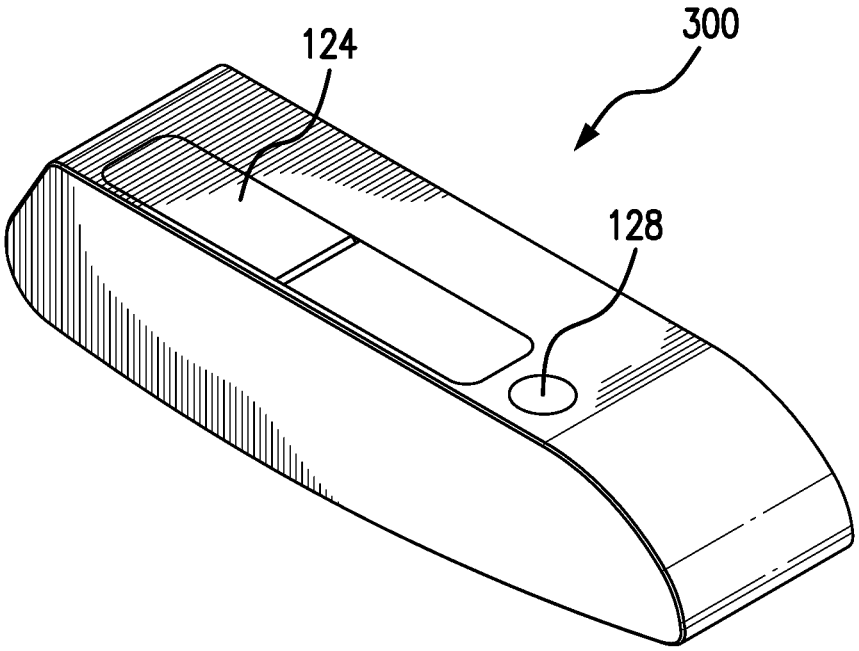
FIG. 15A illustrates a putter head according to another embodiment of the present disclosure.
Figure 15B:
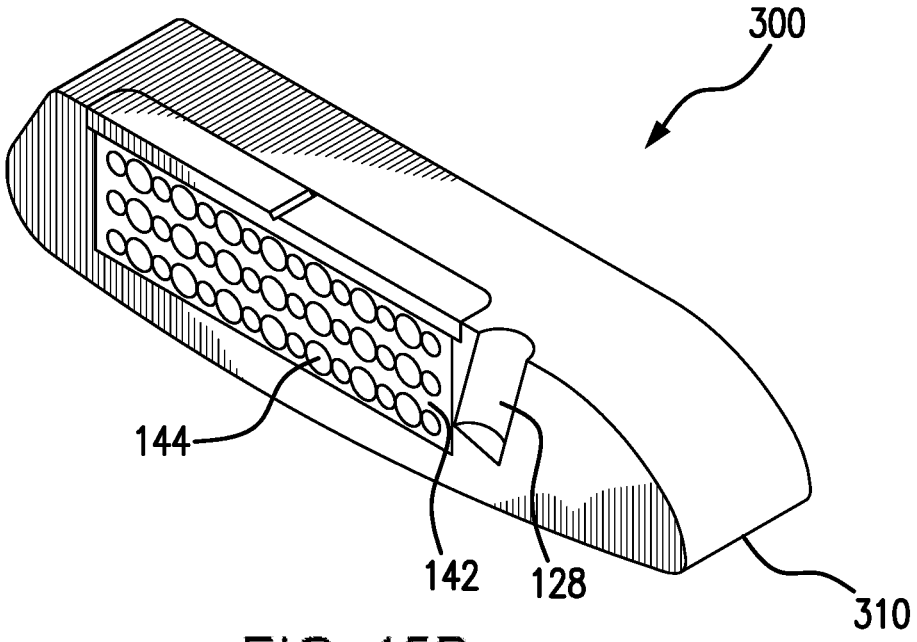
FIG. 15B illustrates an isometric cross-sectional view of the putter head of FIG. 15A.
Figure 15C:
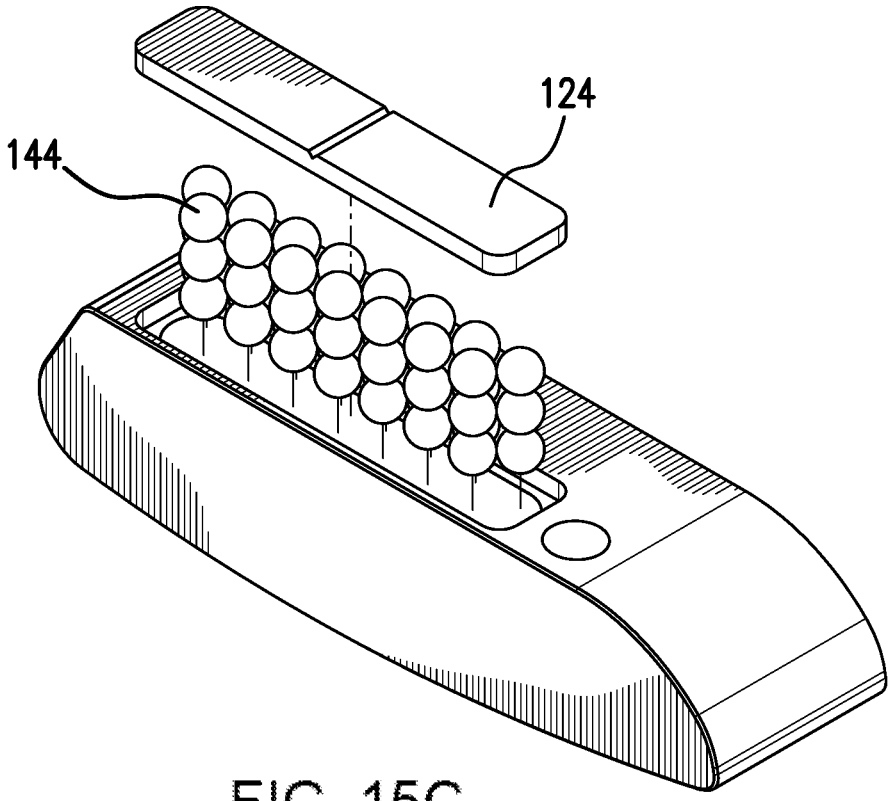
FIG. 15C illustrates an isometric exploded view of the putter head of FIGS. 15A and 15B.
Figure 15D:
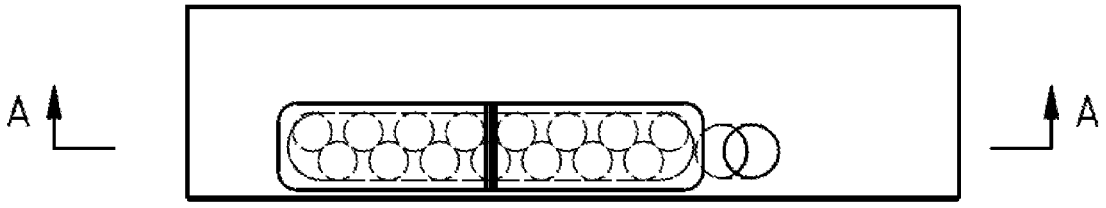
FIG. 15D illustrates a top perspective through-view of the putter head of FIGS. 15A-15C.
Figure 15E:
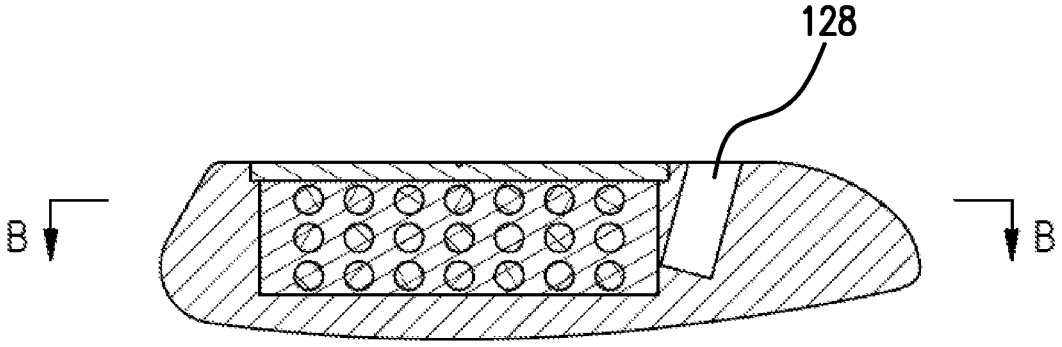
FIG. 15E illustrates a cross-sectional view along plane A-A shown in FIG. 15D.
Figure 15F:
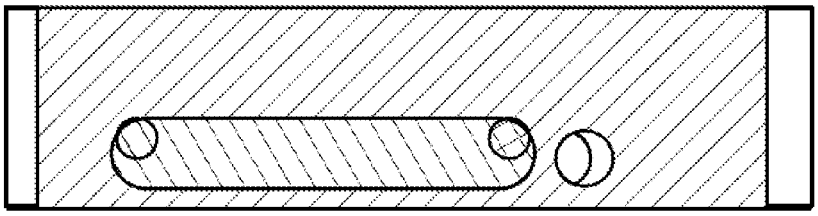
FIG. 15F illustrates a cross-sectional view along plane B-B shown in FIG. 15E.
Figure 15G:
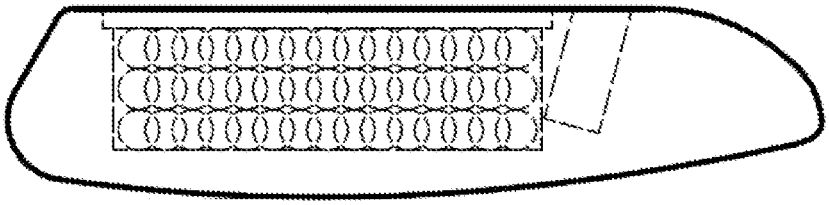
FIG. 15G illustrates a front perspective cross-sectional view of the putter head of FIGS. 15A-15F.

With continued reference to FIGS. 1-8, the body 110 may also include a receptacle 128 on the outer surface 112 configured to receive the shaft (not shown). The receptacle 128 may be placed on the body 110 such that the shaft forms an angle measured between the shaft and the putter head 100. The receptacle 128 may be disposed on various portions of the body 110, and the placement of the receptacle 128 may depend on size, shape, and/or the desired use of the golf putter head 100 and on the handedness (i.e. right- or left-handed) of the user. An alternative embodiment is depicted in FIG. 14 that shows the receptacle 128 being located at a different portion of the outer surface 112 than in FIGS. 1-8.

In some embodiments, a cavity 130 may be defined inside the body 110. The cavity 130 may be defined to have various shapes. Referring to FIGS. 1-25, the cavity may be generally rectangular prismatic. In some embodiments, the cavity may be disposed in different locations within the body. As shown in the illustrative embodiment of FIGS. 1-8, the cavity 130 is substantially centered within the body 110 when looking in the direction perpendicular to the striking surface 126. In some embodiments, the cavity 130 may be disposed in a different location in the body. Different placement may affect characteristics of the golf putter use, for example its weight distribution and balance. In some embodiments, the cavity may be larger than depicted in the illustrative embodiments, and it may be disposed in different locations within the body. It will be understood that the volume, shape, and positioning of the cavity may affect characteristics of the golf putter head, and any described or illustrated example embodiments are not intended to limit this disclosure.

The body 110 further includes an opening 132 on the outer surface 112 that places the outer surface 112 and the inner surface 114 in fluid communication. The opening 132 may provide a passage to the cavity 130 inside the body 110. The opening 132 may be disposed on various locations on the body. In some embodiments, the opening 132 may be defined by the front face 116 of the body. In another embodiment, the opening may be defined by the top face 118 of the body. A body 110 may include a plurality of openings 132, and each of the openings may be on the same face, on different faces, or a combination of placements.

The body 110 may further include a cover 124 configured to be placed onto or into the opening 132 on the body 110. The cover 124 may be positioned such that when it is affixed to the body, the inner surface 114 defining the cavity 130 does not fluidly contact the outer surface 112 of the body. As illustrated in the embodiment of FIGS. 1-8, the cover 124 may include the striking surface 126. Alternatively, the cover 124 may be separate from the striking surface 126. As shown in FIGS. 9A-9G, in some embodiments, the opening 132 and the cover 124 are disposed on the top face 118, while the striking surface 126 is disposed on the front face 116.

The cover 124 may be fixedly attached to the body via fasteners, adhesives, or mechanical interaction of structural features. Suitable methods of attachment include, but are not limited to, glues, epoxies, nails, screws, rivets, protrusions with grooves, or interferences between structural elements. When attached, the cover may be flush with the outer surface of the body. In some embodiments, the cover 124 may be designed to be easily removable to expose the cavity 130 within the body. Alternatively, the cover 124 may be designed to be securely fixed to the body such that the cavity 130 is not easily accessible without tools and/or damage to the body and/or cover.

As a person skilled in the art would appreciate, the body may have various shapes and configurations that may be useful in the golfing discipline. For example, the body may have a generally rectangular, semi-circular, or trapezoidal cross-section, or it may be another suitable cross-sectional shape. Referring to FIGS. 1-8, for example, the body 110 may have a semi-circular cross section. The body may be manufactured with various dimensions. In some embodiments, the striking surface 126 may have a length of up to about 6 inches and a height of up to about 3 inches. Referring to the illustrative embodiment of FIG. 1, the body 110 may be about 4 inches in length in the x-direction, about 1 inch in height in the y-direction, and about 3 inches deep in the z-direction. The body 110 may be about 4.6875 inches in the x-direction, about 1.25 inches in the y-direction, and about 1.25 inches in the z-direction. In some embodiments, manufacturing tolerances may be ±0.01 inches. In other embodiments, manufacturing tolerances may be ±0.005 inches. The depicted dimensions and tolerances are illustrative only and are not meant to limit the scope of this disclosure. It will be understood that the body may have different dimensions and that this disclosure is not limited to a specific body size or shape. In some embodiments, for example, the body may be approximately 4 inches in the x-direction, approximately 3 inches in the z-direction, and approximately 1 inch in the y-direction. The body may alternatively be approximately 4 inches in the x-direction, 1 inch in the y-direction, and 0.75 inches in the z-direction. In further embodiments, the body may be approximately 5 inches in the x-direction, 1.1875 inches in the y-direction, and 1.25 inches in the z-direction. In a further embodiment, the body may be approximately 5 inches in the x-direction, 1.1875 inches in the y-direction, and 1 inch in the z-direction.

The body of the golf putter head may be manufactured out of any suitable material. It will be understood that materials and compositions may vary to affect characteristics of the putter, such as weight and durability, and materials described in the embodiments herein are not meant to limit the scope of this disclosure. In some embodiments, the body includes an aluminum alloy. In a preferred embodiment, the body is manufactured at least in part of 6061 aluminum alloy. The material making up the body may include other metals and metal alloys, for example steel, iron, or titanium. In some embodiments, the golf putter head may comprise stainless steel, for example, 303 stainless steel and 304 stainless steel, as well as other types of stainless steel. Additionally, or alternatively, the body may include non-metallic material as well, for example carbon-based materials or plastics, for example graphite and polyethylene, or other materials. In some embodiments, it may be preferable that the materials used in the body of the head do not exhibit magnetic properties.

The golf putter head 100 may include a material configured to absorb and redistribute a portion of the force that acts on the head when the head contacts a golf ball. Such material may be different from the material comprising the body of the head and may comprise an insert 140 configured to be placed in or on the golf putter head. Referring to FIGS. 1-8, the insert 140 includes a first material 142 and a shock absorbing element 144.

The first material 142 may include an elastomeric material. In some embodiments, the first material 142 includes a silicone elastomer, for example polyvinyl siloxane. The first material may be one material or it may include multiple materials. The first material 142 may be a solid or it may be a semi-solid, for example a hydrogel, xerogel, or organogel. In some embodiments, the first material 142 may be an adhesive. In some embodiments, the first material 142 may include an epoxy resin. Other suitable materials may be used to comprise the first material 142, such as, but not limited to, plastics, rubbers, and liquids. In some embodiments, it may be preferable that the first material 142 has a solid or a semi-solid consistency such that it does not leak after manufacture or during use. After insertion into the cavity 130 or during use, the first material 142 may be in a solid state. Alternatively, the first material 142 may remain in a semi-solid, gelatinous, or viscous state without solidifying completely.

Referring still to FIGS. 1-8, the first material 142 may be disposed within the cavity 130 in the body 110. The first material 142 may be the only material comprising insert 140, or it may be a portion of the insert 140. The first material 142 may have a fixed volume such that it completely fills the cavity 130.

The insert 140 may further include a shock absorbing element 144. The insert 140 may comprise only the shock absorbing element 144. Alternatively, the insert 140 may include at least the shock absorbing element 144 and the first material 142. In some embodiments, the shock absorbing element 144 may be partially or entirely suspended, embedded, or encapsulated in the first material 142. The shock absorbing element 144 may be disposed in various locations inside the cavity 130. For example, it may be centered within the cavity along the x-, y-, and/or z-directions. In some embodiments, the shock absorbing element 144 may contact the inner surface 114 or the cover 124. Alternatively, it may be positioned a distance away from any portion of the body 110.

In some embodiments, the shock absorbing material may comprise a magnetic element, for example a rare-earth magnetic element. Suitable magnets may include neodymium and samarium-cobalt. It will be understood that other magnetic elements may be used, as well as combinations of magnetic elements, and the examples above are not limiting. The properties of a magnetic element may be advantageous for increasing shock absorption. The magnetic attraction and resistance within portion of the shock absorbing material may dampen and improve the physical transmission of force from contacting a golf ball. Neodymium, specifically, allows for very strong magnetic properties in relatively small pieces, thus allowing more magnetic elements to with stronger magnetism to reside in a particular volume.

The shock absorbing element 144 may be manufactured to have various shapes and dimensions. The shock absorbing element 144 may be a spheroid or a polyhedron. In some embodiments, the shock absorbing element 144 may be a rectangular prism. Referring to FIGS. 1-8, the shock absorbing element 144 of some embodiments may be spherical. As shown in the illustrative embodiments of FIGS. 12 and 13, the shock absorbing element 144 may be a rectangular prism.

Figure 1:
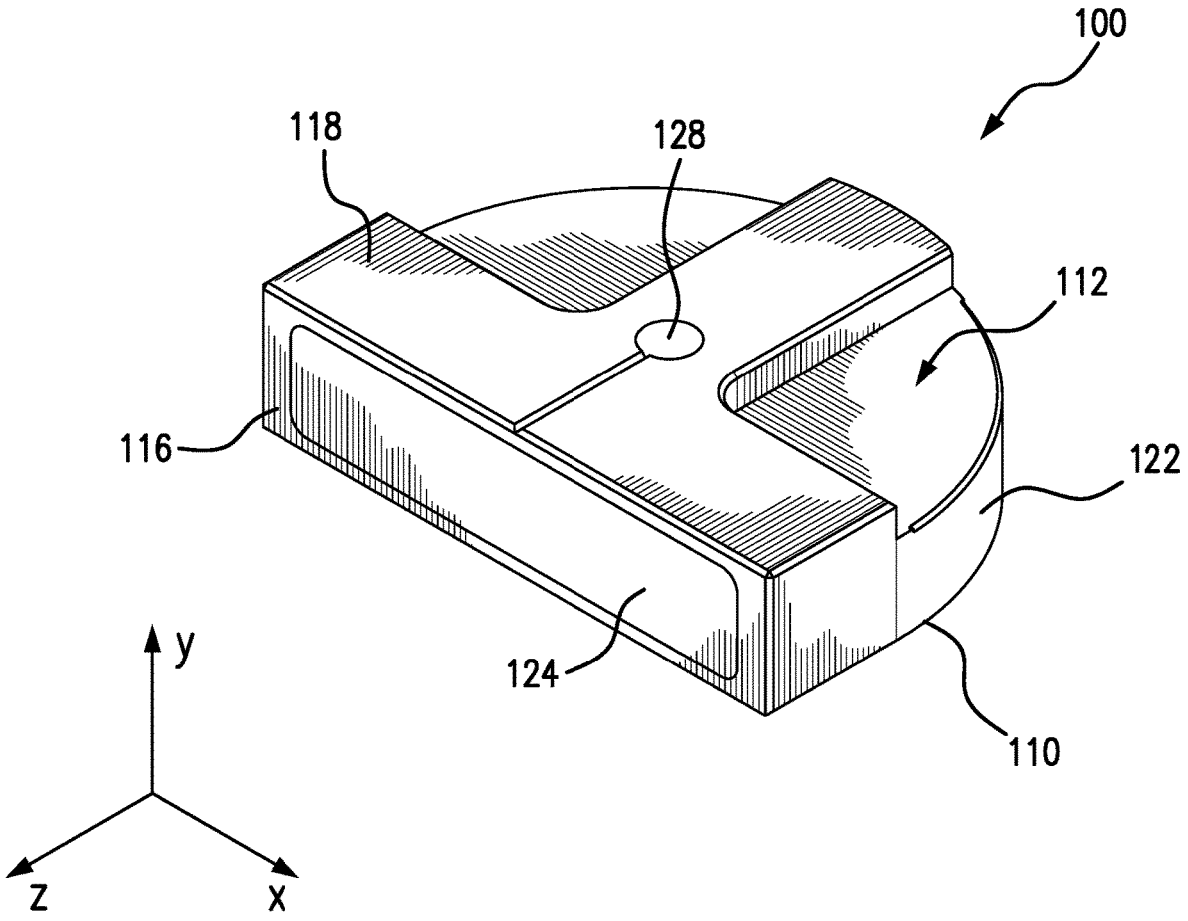
FIG. 1 illustrates an isometric view of a putter head according to an embodiment of the present disclosure.
Figure 2:
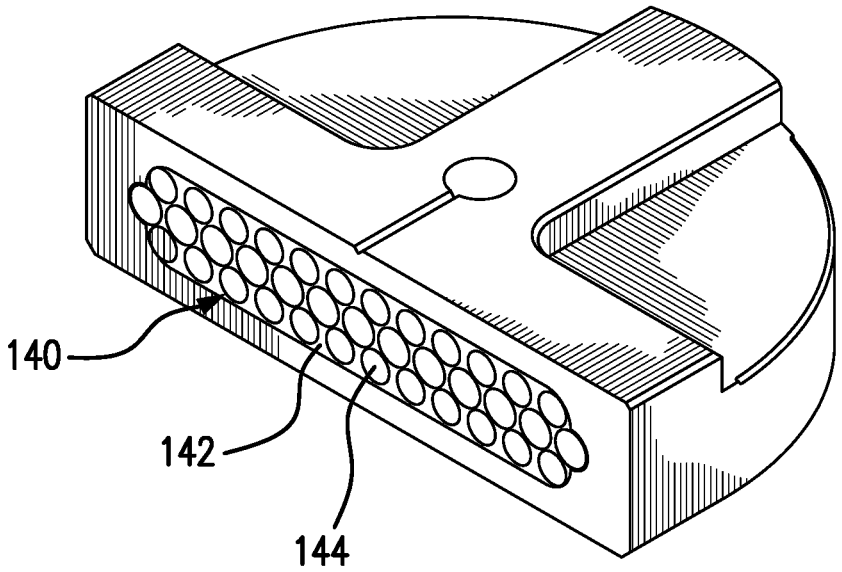
FIG. 2 illustrates an isometric cross-sectional view of the putter head of FIG. 1.
Figure 3:
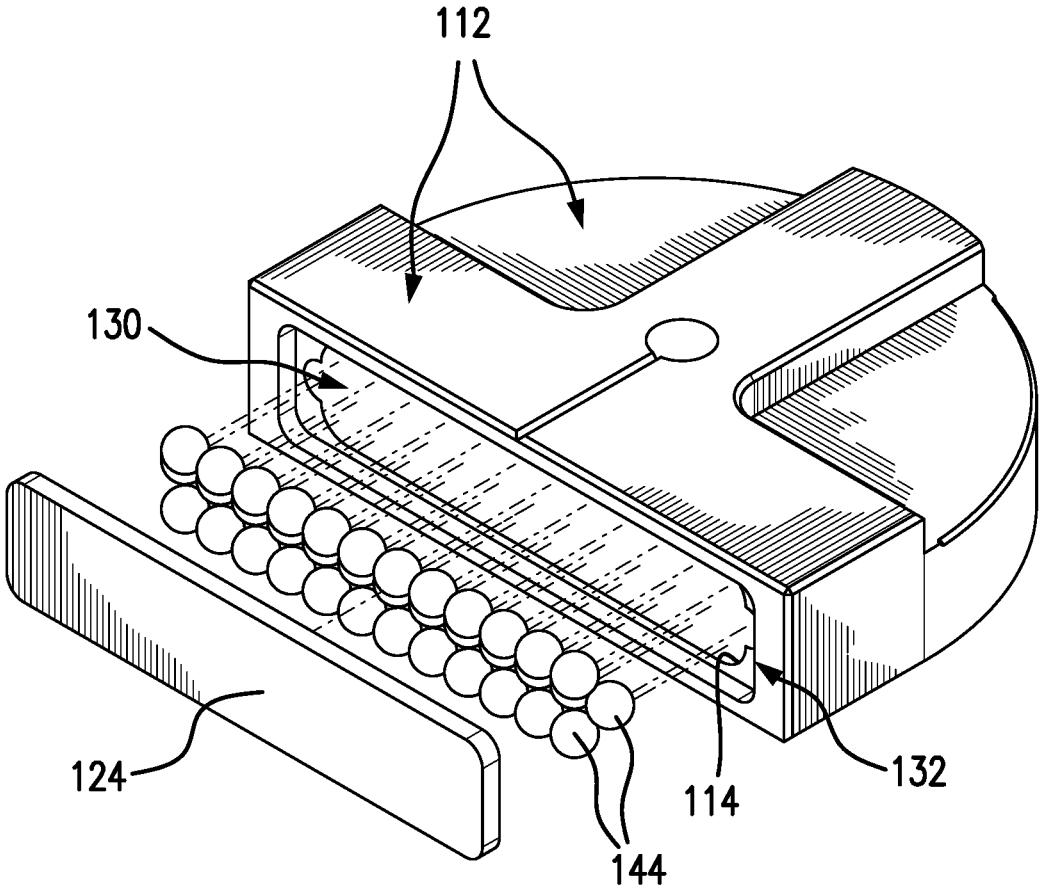
FIG. 3 illustrates an isometric exploded view of the putter head of FIGS. 1 and 2.
Figure 4:
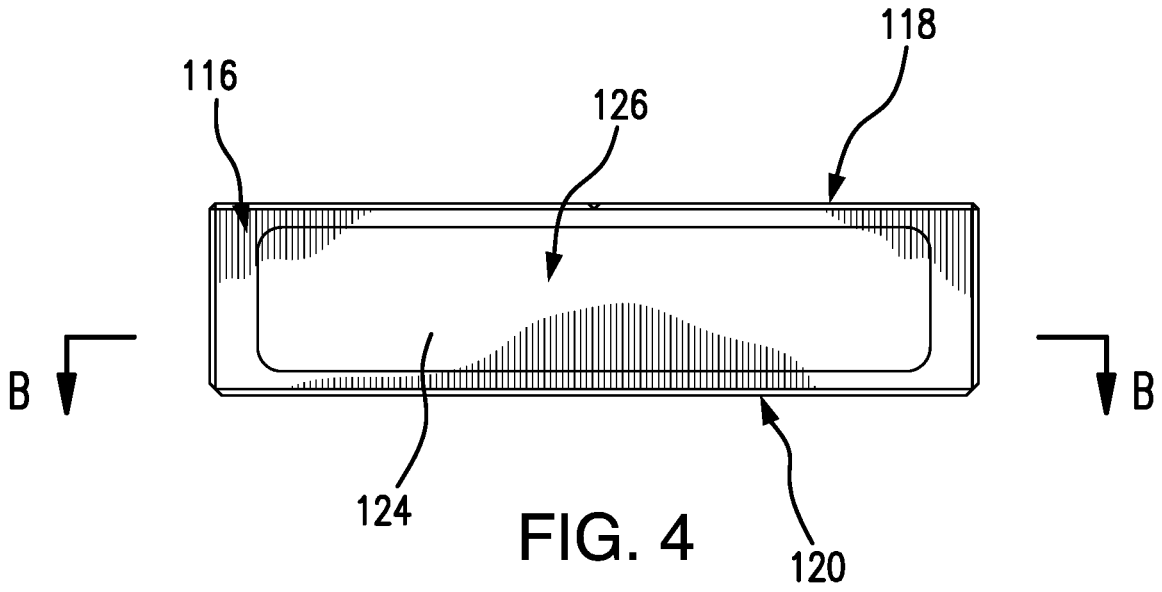
FIG. 4 illustrates a front perspective view of the putter head of FIGS. 1-3.
Figure 5:
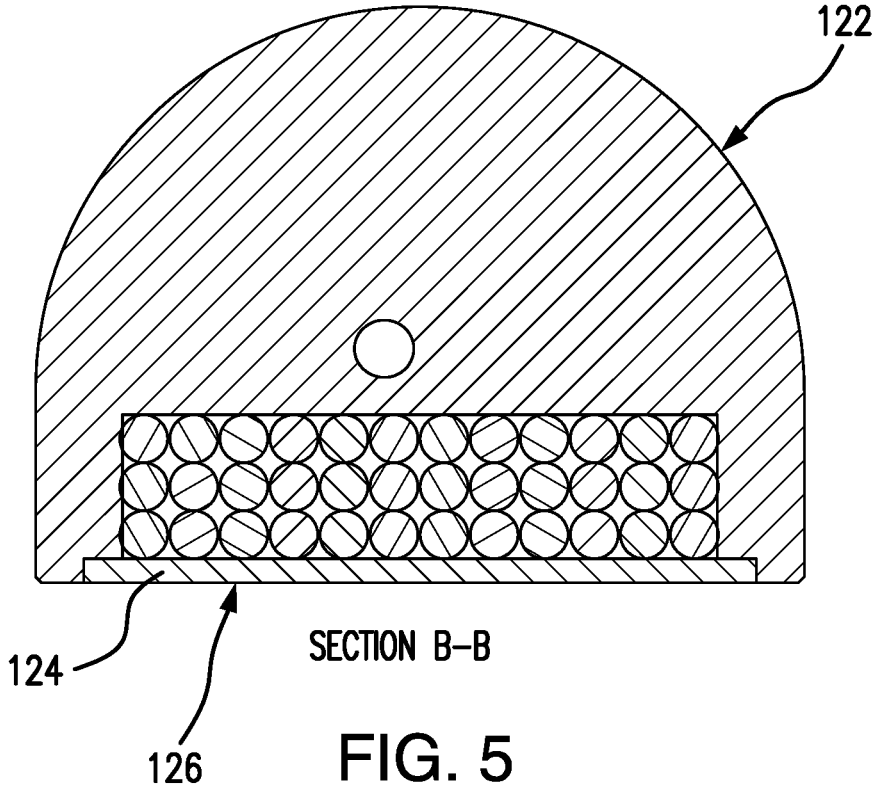
FIG. 5 illustrates a top cross-sectional view of the putter head of FIGS. 1-4 along plane B-B shown in FIG. 4.
Figure 6:
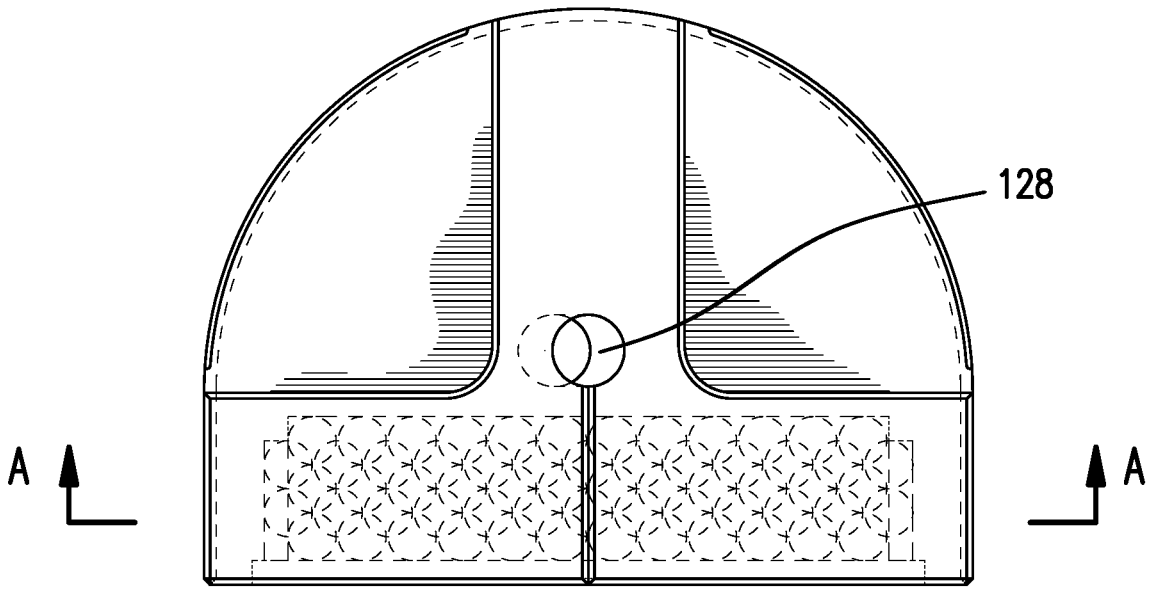
FIG. 6 illustrates a top-down cross-sectional view of the putter head of FIGS. 1-5.
Figure 7:
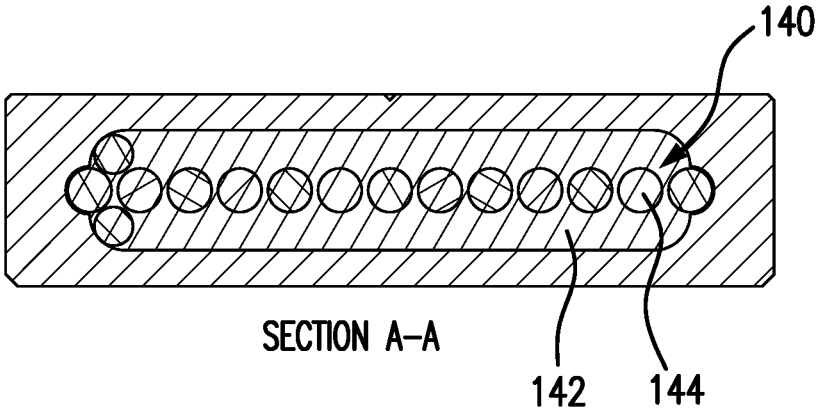
FIG. 7 illustrates a front perspective cross-sectional view of the putter along plane A-A shown in FIG. 6.
Figure 8:
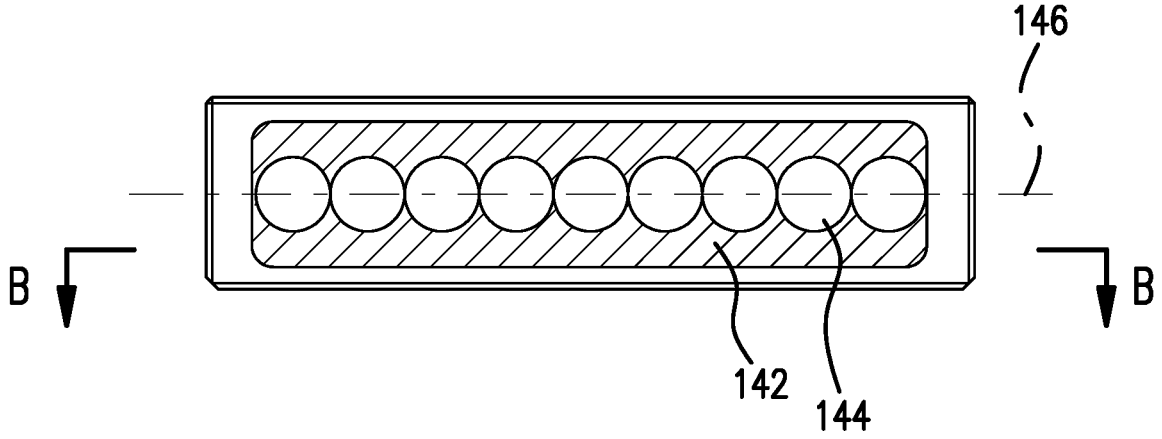
FIG. 8 illustrates a front perspective view of the putter head of FIGS. 1-7 shown without a cover.
Figure 9A:
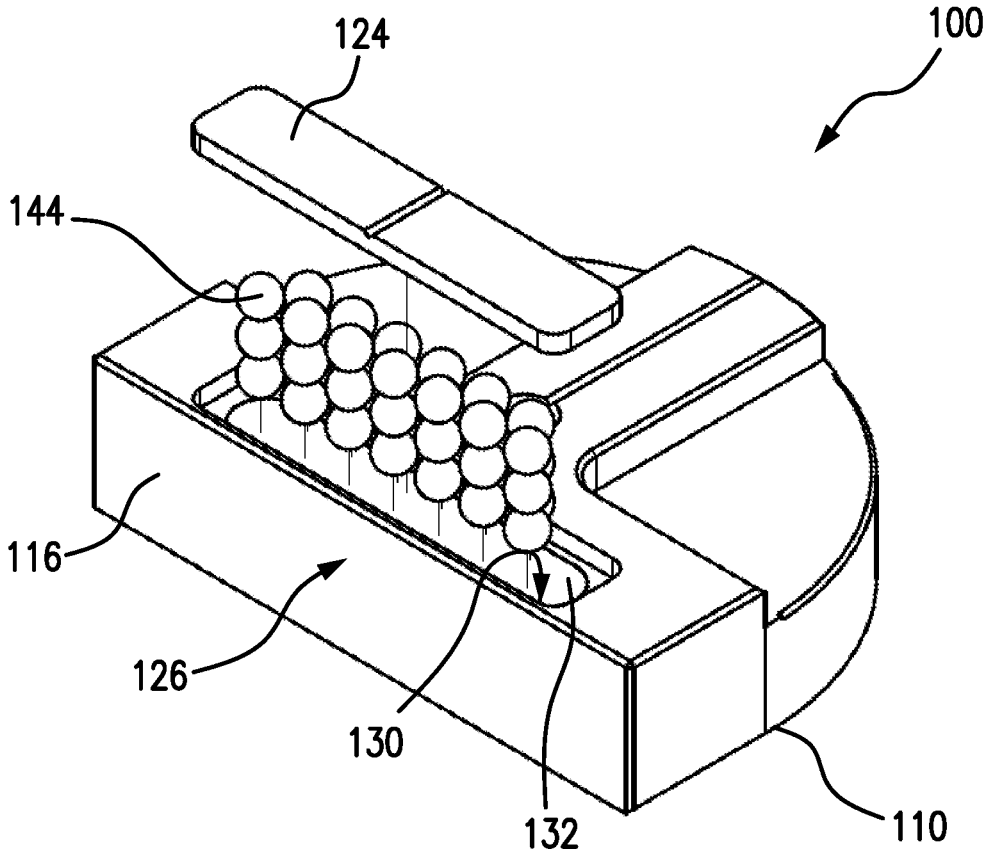
FIG. 9A illustrates an isometric exploded view of a putter head according to another embodiment.
Figure 9B:
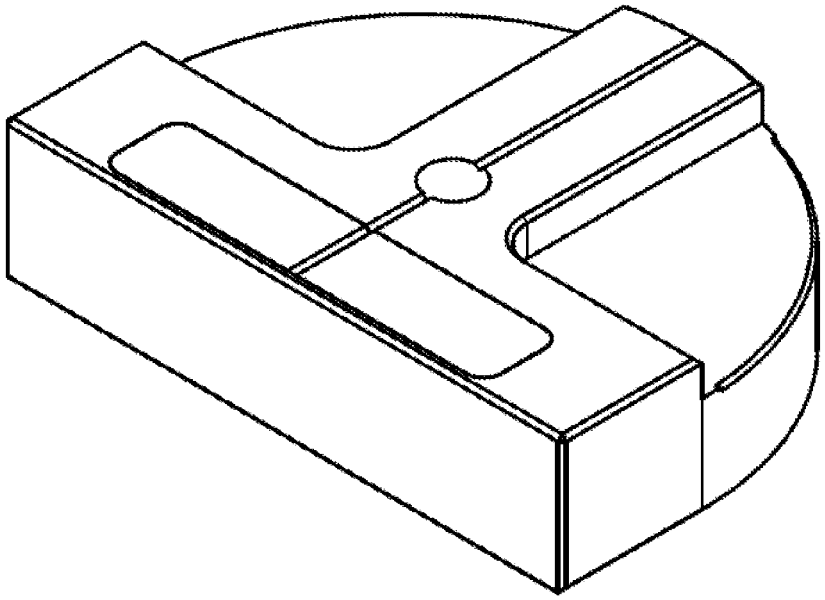
FIG. 9B illustrates an isometric view of the putter head of FIG. 9A.
Figure 9C:
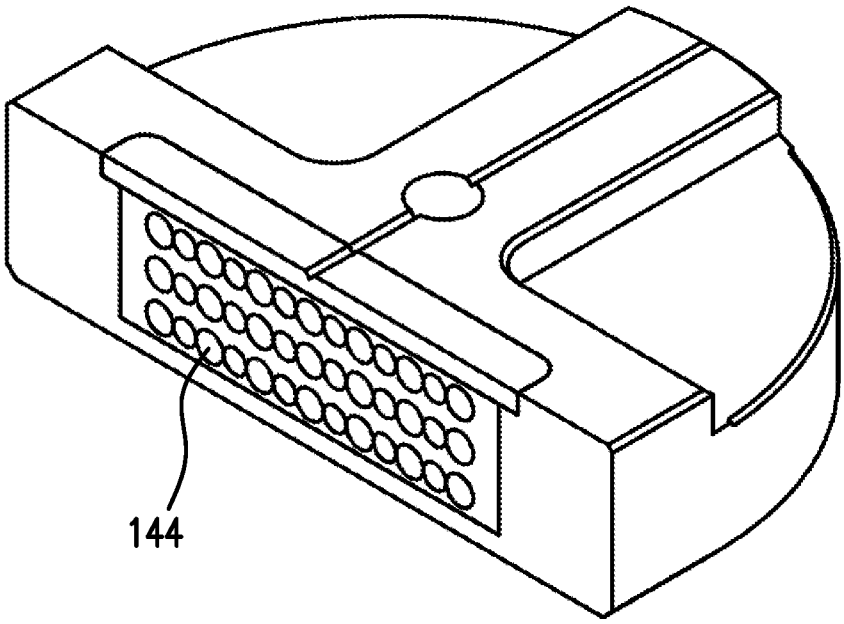
FIG. 9C illustrates a cut-away isometric view of the putter head of FIGS. 9A and 9B.
Figure 9D:
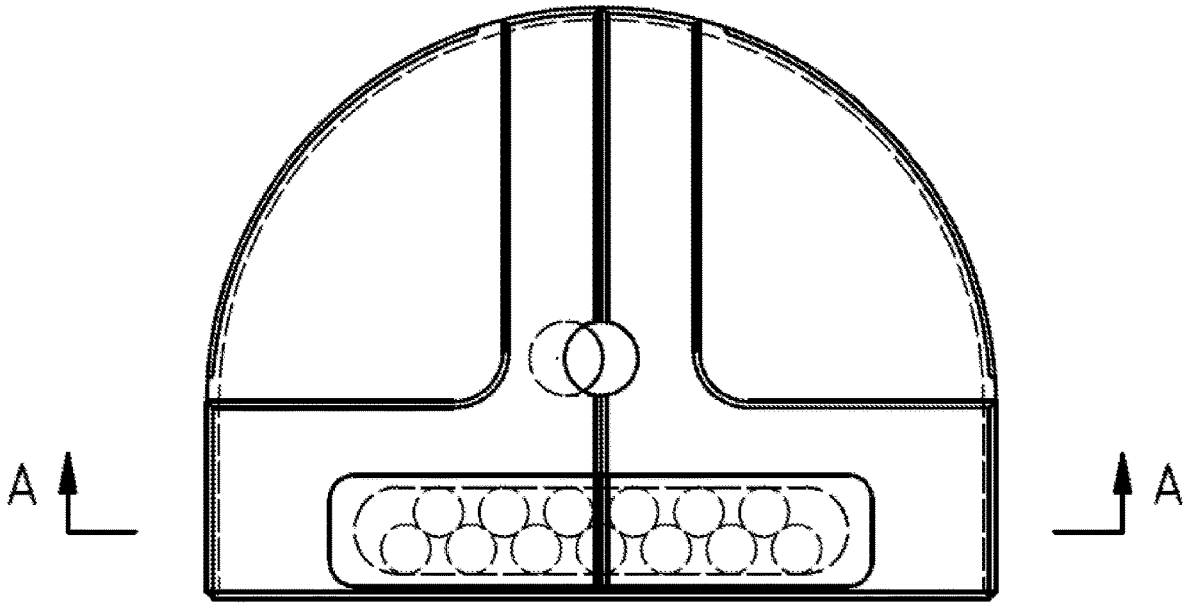
FIG. 9D illustrates a top-down through-view of the putter head of FIGS. 9A-9C.
Figure 9E:
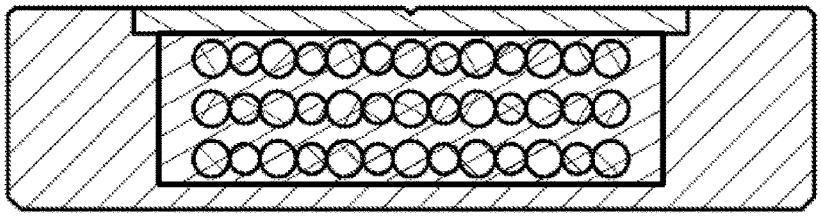
FIG. 9E illustrates a cross-sectional view of the putter head along plane A-A shown in FIG. 9D.
Figure 9F:
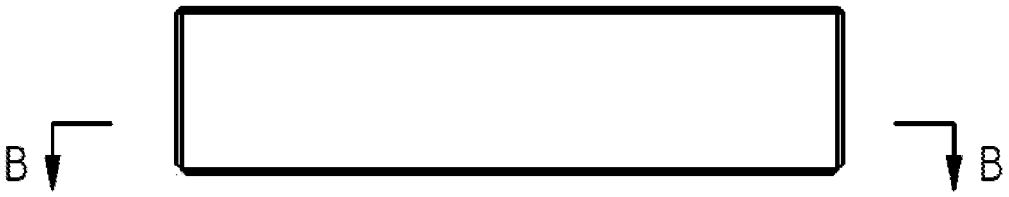
FIG. 9F illustrates a front perspective view of the putter head of FIGS. 9A-9E.
Figure 9G:
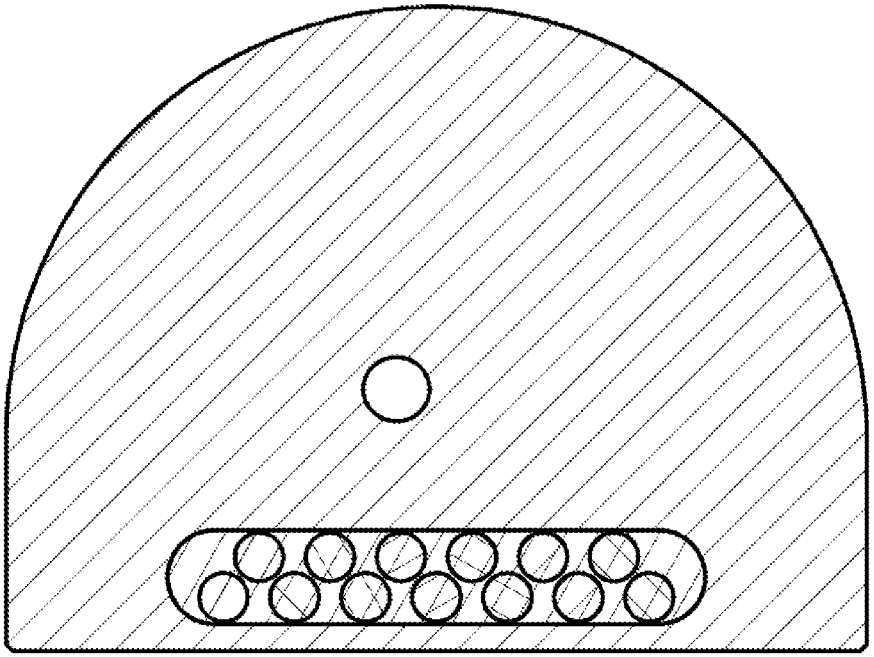
FIG. 9G illustrates a cross-sectional view of the putter head along plane B-B shown in FIG. 9F.
Figure 10:
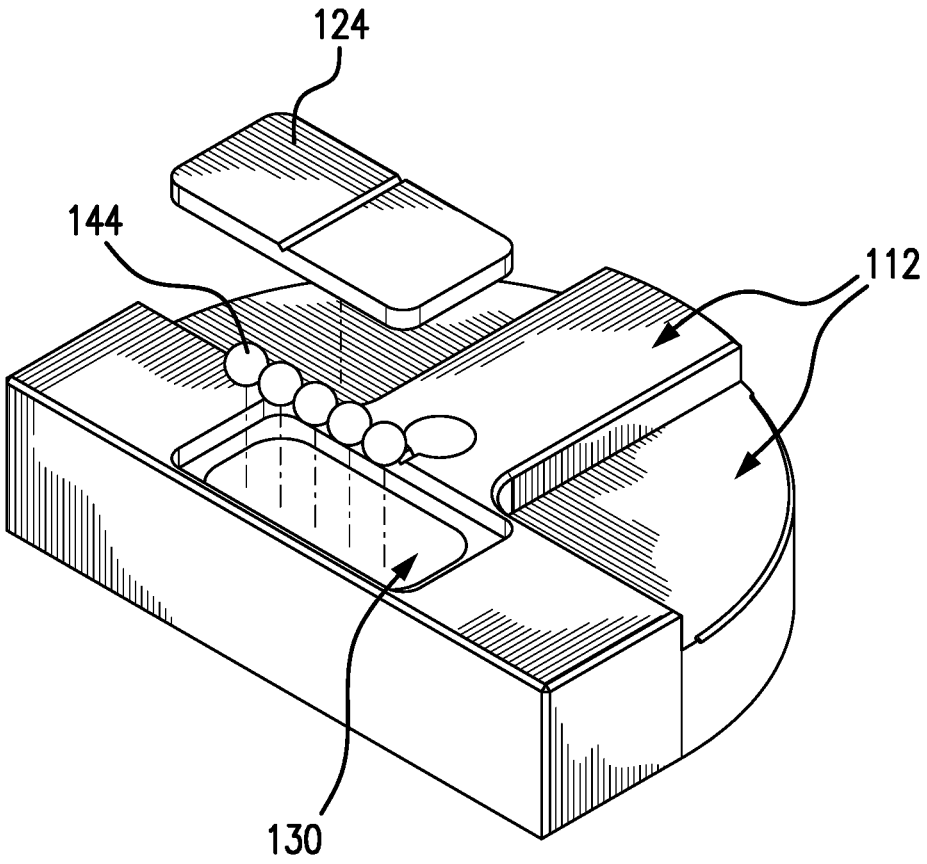
FIG. 10 illustrates an isometric exploded view of a putter head according to another embodiment.
Figure 11A:
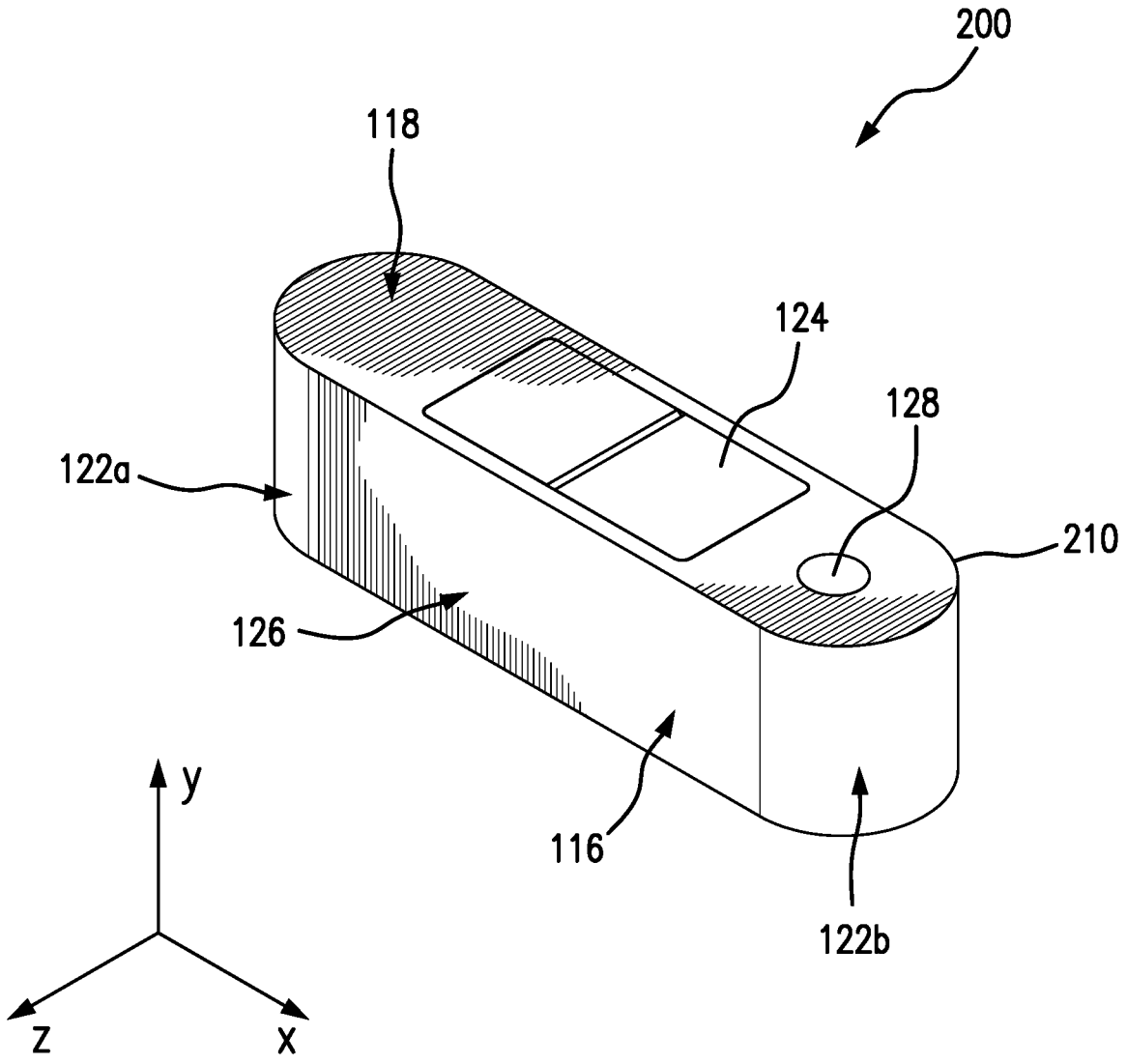
FIG. 11A illustrates an isometric view of a putter head according to another embodiment of the present disclosure.
Figure 11B:
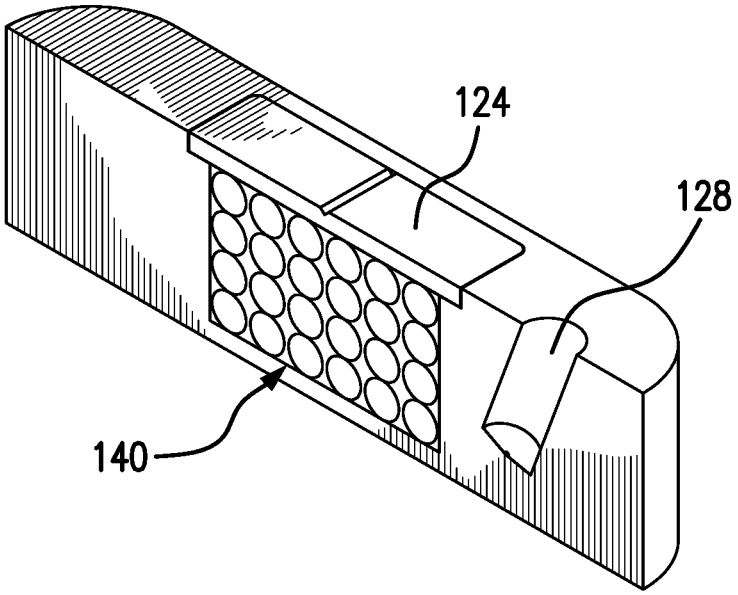
FIG. 11B illustrates an isometric cross-sectional view of the putter head of FIG. 11A.
Figure 11C:
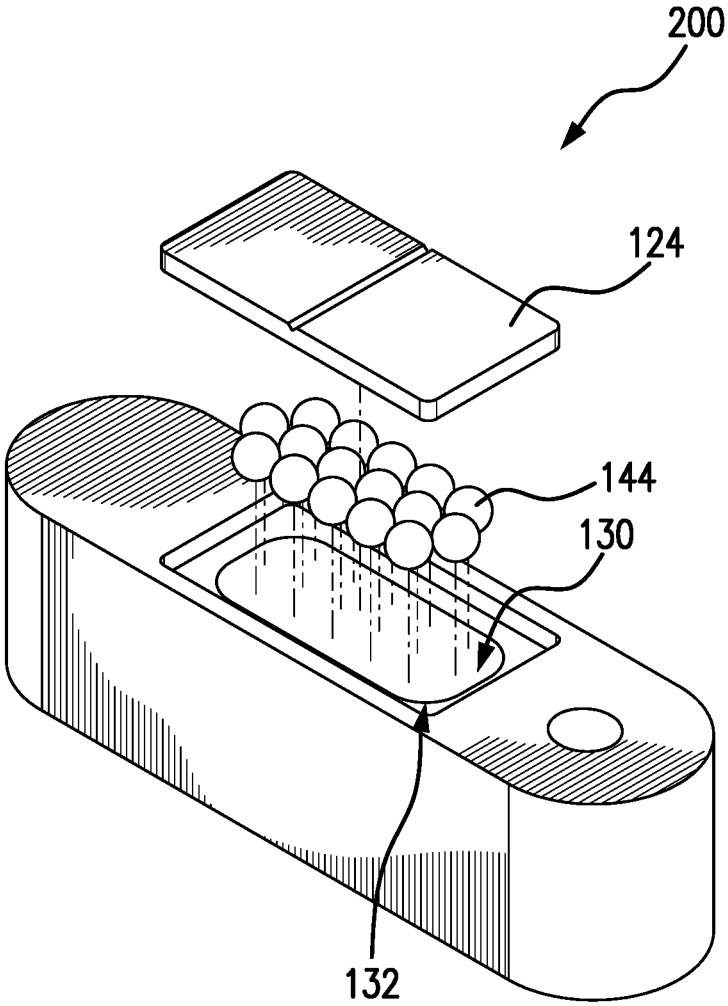
FIG. 11C illustrates an exploded isometric view of the putter head of FIGS. 11A and 11B.
Figure 11D:
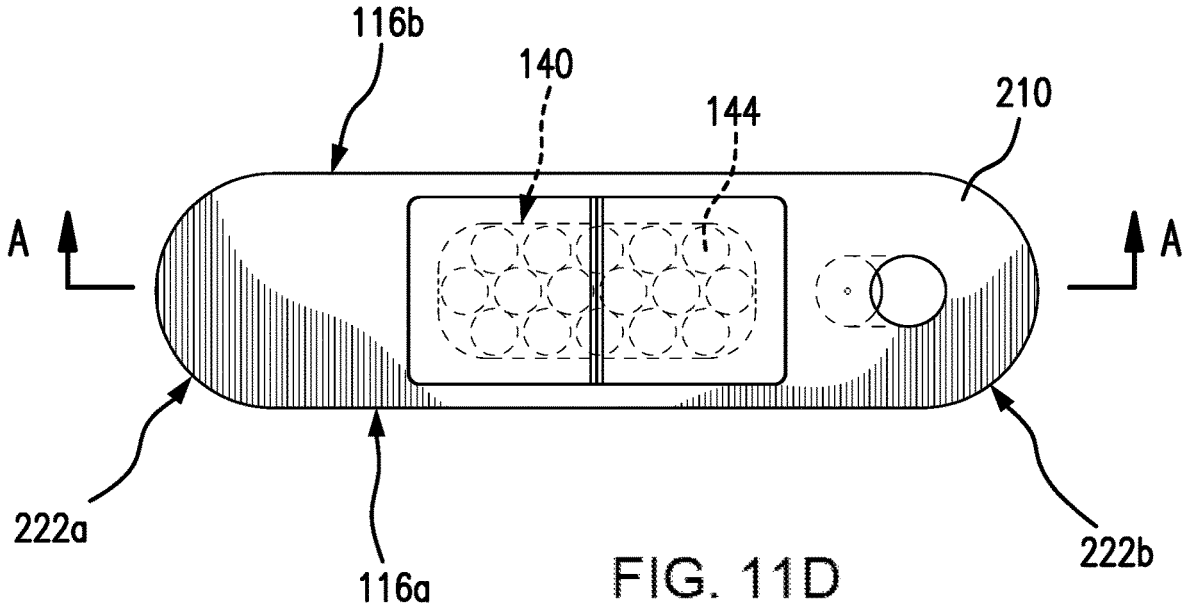
FIG. 11D illustrates a top-down through-view of the putter head of FIGS. 11A-11C.
Figure 11E:
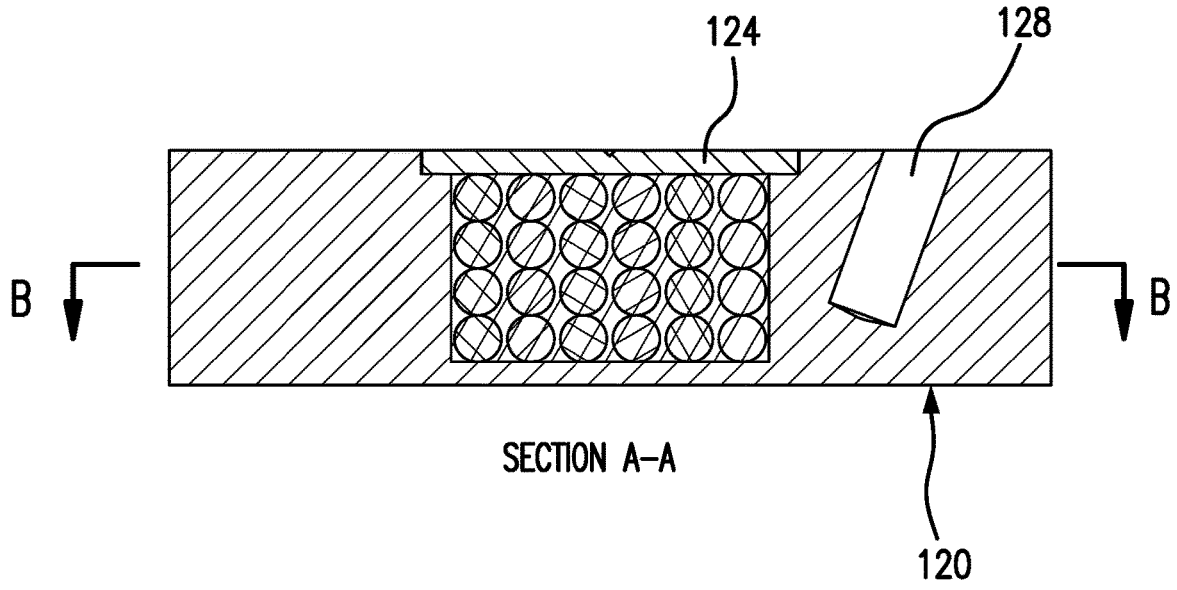
FIG. 11E illustrates a cross-sectional view along plane A-A shown in FIG. 11D.
Figure 11F:
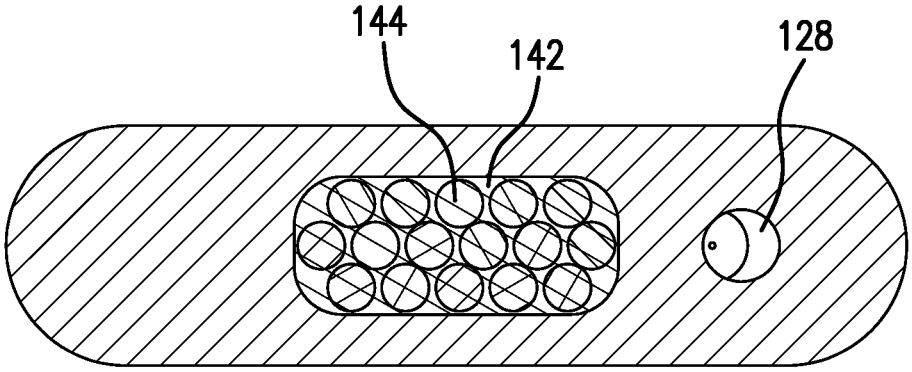
FIG. 11F illustrates a cross-sectional view along plane B-B shown in FIG. 11E.
Figure 11G:
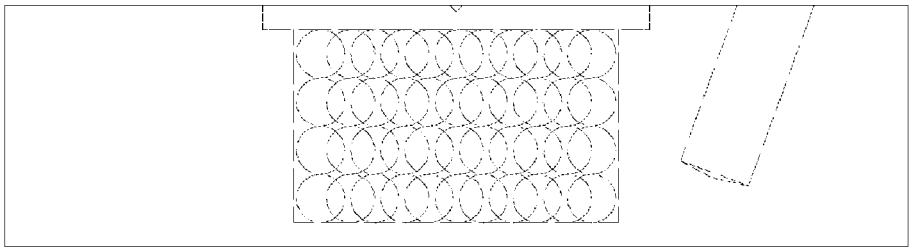
FIG. 11G illustrates a cross-sectional view of the putter head of FIGS. 11A-11E.
Figure 12:
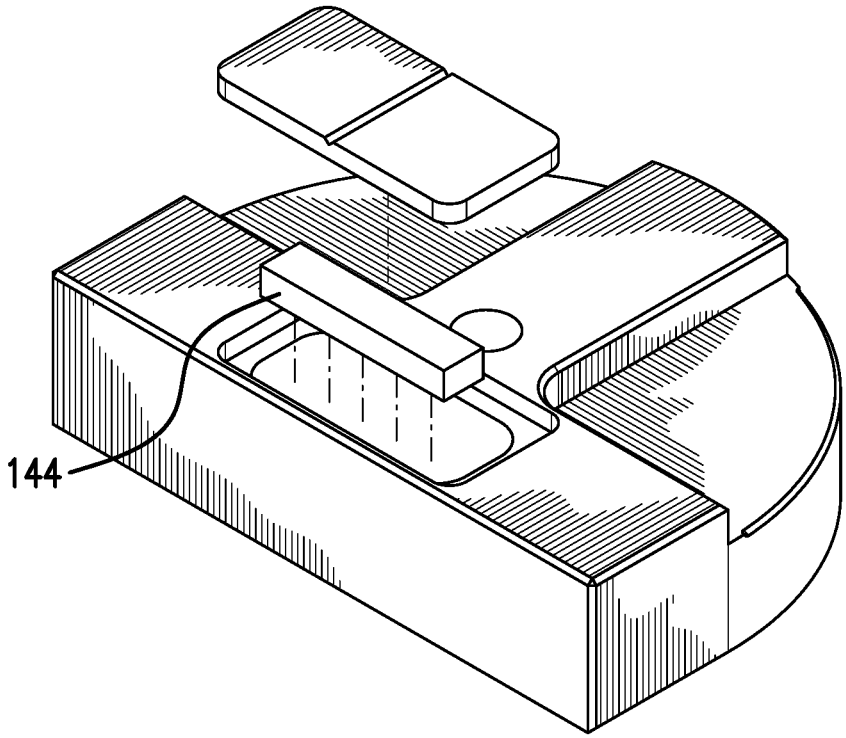
FIG. 12 illustrates an isometric exploded view of a putter head according to another embodiment.
Figure 13:
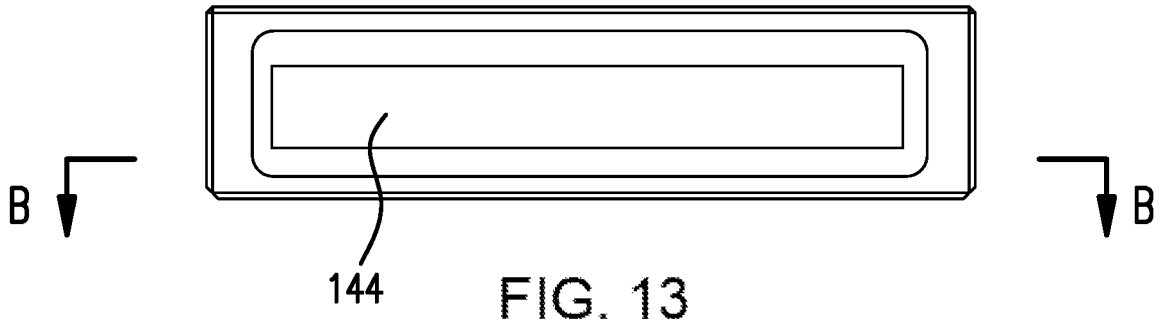
FIG. 13 illustrates a front cross-sectional view of the putter of FIG. 12.

The insert 140 may include one or a plurality of shock absorbing elements 144. The plurality of shock absorbing elements 144 may be configured in various geometries, for example linear or radial. Referring to FIGS. 9A-10, the plurality of shock absorbing elements 144 may be arranged in a straight line or in a lattice. Alternatively, the shock absorbing elements 144 may be disposed in the cavity 130 in a random orientation. The quantity of shock absorbing elements 144 may vary on the weight of the putter head and on the shock absorbing qualities desired. The insert 140 may include any suitable number of shock absorbing elements, for example 1, 2, 3, 4, 5, 6, 7, 8, 9, 10, 11, 12, 13, 14, 15, 16, 17, 18, 19, or 20 separate shock absorbing elements. In some embodiments, more shock absorbing elements are possible, and the above quantities serve as examples rather than limitations. The magnetic properties of at least some or all of the shock absorbing elements 144 may improve the dampening of the force transmitted to the golf putter head when the body 110 contacts the ball. The force may pass from some of the shock absorbing elements 144 top other shock absorbing elements 144 and throughout the rest of the insert 140. In addition to physically transmitting force from one shock absorbing element 144 to an adjacent one through physical contact, a portion of the force may also be imparted through magnetic resistance between adjacent shock absorbing elements 144.

The shock absorbing element 144 may be manufactured to various sizes. In some embodiments, a shock absorbing element 144 may be substantially the same size as the cavity in at least one dimension. In other embodiments, the shock absorbing element 144 may have a length, a width, and a depth each ranging from about 0.005 inches to about 6 inches. The dimensions of length, width, and depth may be the same or different. In another embodiment, the diameter of the shock absorbing element 144 may range from about 0.005 inches to about 2 inches. In another embodiment, the shock absorbing element 144 may range from about 0.1 inches to about 1 inches. In a preferred embodiment, the shock absorbing element 144 has a diameter of about 0.25 inches. In some embodiments, the plurality of shock absorbing elements 144 may all have the same shapes and dimensions. Alternatively, individual shock absorbing elements in the plurality may have different shapes, configurations, and size dimensions from at least some of the other shock absorbing elements.

The plurality of shock absorbing elements 144 may be configured to have a material between them such that none of the shock absorbing elements 144 contact any other shock absorbing elements 144. Alternatively, in a preferred embodiment, each shock absorbing element 144 contacts at least one adjacent shock absorbing element.

A golf putter head as disclosed herein may engage with a golf club shaft (not shown). The shaft may be received in the shaft receptacle 128 defined by, or, alternatively, disposed on, the external surface 112 of the body 110. The shaft may fixedly attach to the shaft receptacle 128. Various methods of securing are available, such as, but not limited to, mechanical fasteners, adhesives, or frictional interference fit. Any shaft suitable for use with a gold club head may be used, and one shaft may be interchangeable with another shaft.

Referring to the illustrative embodiment of FIGS. 9A-10, an embodiment of a golf putter head may include one or more rows of multiple spherical shock absorbing elements 144. All of the shock absorbing elements 144 in each row may be positioned such that their centers lie on the same linear axis 146. When multiple rows are present, multiple linear axes 146 may exist, where each linear axis 146 is parallel to each other linear axis 146. Each of the shock absorbing elements 144 may contact an adjacent shock absorbing element 144.

Referring to FIG. 10, in some embodiments, the insert 140 may include only one row of shock absorbing elements. Experimental data suggests that such an embodiment may be advantageous as it avoids difficulties associated with properly organizing a multiple adjacent rows, each having a plurality of shock absorbing elements 144. In some experiments, use of multiple rows of shock absorbing elements led to lower durability long-term durability of the first material 142, and, subsequently, the entire golf putter head. Similar results were observed when the quantity of shock absorbing elements 144 was too high and when the size of the shock absorbing elements 144 was too small. In a preferred embodiment, the insert 140 includes one row of a plurality of shock absorbing elements 144, wherein each shock absorbing element 144 contacts at least one other adjacent shock absorbing element, where the diameter of each shock absorbing element is approximately 0.25 inches, and where the plurality ranges from about 4 to about 12 shock absorbing elements 144.

The golf putter head may be manufactured in numerous ways. The insert 140 may be prepared separately from the head 110 and then inserted into the cavity 130 of the head 110. The first material 142 may be added to a mold (not shown) such that the first material takes a desired shape. One or more shock absorbing elements 144 may be introduced onto or into the first material 142 while the first material is in the mold such that the first material 142 cures while contacting the shock absorbing element 144. Alternatively, the shock absorbing element 144 may be contacted with the first material 142 after the first material has partially or completely cured.

In an alternative manufacturing process, the insert 140 may be formed inside the cavity 130 by introducing the first material 142 into the cavity while the first material is in an uncured state and then permitting the first material to cure. A shock absorbing element 142 may be placed in contact with the first material 142 in the cavity 130 before the first material 142 cures, or the shock absorbing element 142 may be contacted with the first material 142 after the first material has partially or completely cured.

With reference to FIGS. 11A-11G, in which like reference numerals refer to like features in FIGS. 1-10, and in accordance with an alternative embodiment, golf putter head 200 has a body 210 and an insert 140. The body 210 includes an outer surface 112, an inner surface 114, and a cavity 130. The outer surface 112 may include a front face 116, a top face 118, a bottom face 120, and a side face 222. The body 210 of head 200 may include a first front face 116*a* and a second front face 116*b* that is parallel to the first front face 116*a*. The body 220 may include a first side face 222*a* and a second side face 222*b*. The body 220 may further include a striking surface 126. The striking surface 126 may be disposed on the first front face 116*a* or on the second front face 116*b*. In some embodiments the body 220 may include a two striking surfaces 126, such that one of the two striking surfaces is on the first front face 116*a* and the second of the two striking surfaces is on the second front face 116*b*. The outer surface 112 may further define a shaft receptacle 128 configured to receive a golf club shaft (not shown). The body 210 may define a cavity 130 therein, the cavity being configured to receive an insert 140.

In some embodiments, golf putter heads may be customizable for individual users. As will be understood by skilled persons in the art, specific customizations are not limited to those described here. Golf putter heads may be colored, for example through a painting or an anodizing process. Additionally, heads may be engraved for design, comfort, or user preference.

The golf putter heads may be manufactured to meet different requirements, specifications, and personal preferences. Some elements described throughout this application may be altered or varied as to location, dimensions, materials, or other properties, and it will be understood that the present disclosure should not be limited to only the illustrative embodiments depicted herein. Referring to FIG. 14, for example, the shaft receptacle 128 may be disposed substantially off-center on the top surface 112 and be adjacent the back surface 122. It will be understood that other placements are possible (e.g., a mirrored placement having the shaft receptacle 128 on the opposite side of the top surface 112).

Furthermore, the golf putter head may be manufactured to have various shapes. Referring to FIGS. 15A-15G, a golf putter head 300 is depicted having a non-uniformly shaped body 310 that takes a different form from bodies 110, 210 discussed throughout this application. Similarly, FIGS. 16A 16G illustrate a golf putter head 400 having a non-uniformly shaped body 410 that is different from bodies 110, 210, 310. FIGS. 17A-17G further illustrate another embodiment showing a golf putter head 500 having a body 510. It will be understood that while specific golf putter head shapes and sizes are disclosed herein, the application is not intended to be limited to only those particular shapes and sizes illustrated.

Without necessarily binding ourselves to a sole mechanism, it is believed that the embodiments described herein are advantageous to a user of the golf putter head because the presence of and the interaction of the insert 140 with the body 110, 210 improve control and accuracy of a golf putt. When a golf ball is struck, numerous force vectors act on it causing it to travel in a particular direction and for a particular distance. Depending on the mechanics of the contact of a golf club with the ball, the ball may roll along the playing surface, it may slide along the surface, or it may become airborne for a portion of the distance traveled. Depending on the angles and magnitudes of the force vectors acting on the ball, there may be more or less friction between the playing surface and the exterior of the ball. This friction affects the distance and direction that the ball travels after being struck. When the ball is struck at an optimal loft angle, measured from the vertical with respect to the shaft of the golf club, the ball will remain as close to the ground as possible and will transition from a sliding movement to a rolling movement faster. This provides for better control of the ball's travel distance and direction.

The frictional force between the green and the golf ball will normally put the ball in a state of pure rolling after the bounce phase. If the putter has no loft, the golf ball will initially be in a combined state of sliding and rolling before it finally ends up in a state of pure rolling.

Research suggests that a putted ball performs more consistently when it is struck at a low loft angle, for example approximately 4 degrees of loft. At the instant before the ball is struck from rest, it is sitting on the playing surface, for example slightly below the top surface of a layer of grass. When the ball is struck properly, it lifts off the surface for a part of its total travel distance. For example, in a common putting scenario where the desired travel distance is approximately ten feet, when the ball is struck at a 4 degree loft angle, it is lifted up at a height of about 0.050" to about 0.100" to near the top of the grass. By raising the ball with the 4 degrees loft, the ball is not driven through the grass, avoiding unexpected and difficult-to-control interference from the grass blades that result in bounces. An unwanted bounce may cause inconsistency with distance control.

When the ball is struck, the striking force may apply a back spin to the ball. The angle of back spin in the above exemplary scenario can range from about 0 degrees to about 10 degrees. The lower the angle of back spin, the more control a player has over the ball. With minimal back-spin, the ball will transition from a sliding motion to a rolling motion earlier in its total travel distance, resulting in less sliding and more rolling. Experimental results have shown that at least some back-spin force will likely be applied to the ball. In the exemplary scenario of the ten-foot putt described above, the ball would not complete the transition from a sliding movement to a rolling movement until about two inches from the starting point of impact.

As the ball moves along the surface, and/or through blades of grass, the ball and the surface have a friction force acting between them. This friction force increases the forward spin rate of the ball until the ball completes the transition from sliding movement to rolling movement and attains a "pure roll" state. Pure roll is achieved when the circumference velocity of the ball (inches/second) is equal to the forward velocity of the ball (inches/second). When this distance traveled is equal to the circumference of the ball, the ball is in pure roll. For a 1.68" diameter golf ball, this number is 1.319" forward movement that equals 1.319" circumference rotation through 90 degrees.

If a golf ball is struck at an excessively-high loft angle, it will slide longer than optimal and will have a tendency to bounce. This causes directional control and distance control to suffer. An optimally-struck ball will slide from about 14% to about 20% of the total distance that it travels. Conversely, it will be in pure roll from about 86% to about 80% of the distance traveled. It will be understood that characteristics of the ball travel distance and direction may vary depending on the skill of the golfer, the golf club, the golf ball, the playing terrain, and any other factors that may affect golf ball dynamics, for example, but not limited to, atmospheric pressure and humidity.

The physics associated with striking the ball and how the ball travels affect the distance and direction in which the ball travels. In general, both the ball and the surface on which it rolls become slightly deformed. This is the source of the retarding force that acts on the ball. The force due to the deformed surface will be distributed over the contact area and, in general, will be equivalent to a single force and a couple acting on the ball. This force and couple are, in turn, equivalent to a single force acting at the point on the ball's surface where the resulting moment is equal to that of the couple. This equivalent force can be resolved into a component, n, normal to the surface and a component, f, tangential to the surface. The position of the equivalent single contact point on the golf ball is given by ρ, the perpendicular distance between the normal component of the contact force and the center of mass of the golf ball. The resulting equations of motion for a golf ball, with a moment of inertia I, rolling on a level green will then be:

$$ma_y=-f \tag{1}$$

$$I\alpha_x=n\rho-fR_t \tag{2}$$

where $R_t$, the perpendicular distance between the tangential component of the contact force, f, and the center of mass of the golf ball, is given by:

$$R_t=(R^2-\rho^2) \tag{3}$$

Typically $\rho \ll R$ and the approximation that $R_t=R$ will be used in the analysis. The constraint of rolling will be given by:

$$a_y=-\alpha_x R \tag{4}$$

Solving the equations (1), (2), and (4) above yields acceleration based on:

$$a_y=-(5/7)\rho_g g \tag{5}$$

where $\rho_g=(\rho/R)$.

Experimental measurements of a golf ball rolling on a green have indicated that there is a dependence of the deceleration of a golf ball on its speed, with the retarding force increasing at lower speeds. However, the dependence was found to be small, i.e., a 10% variation over a 14 ft (4.3 m) putt (1 ft=0.3048 m), and the golf ball's deceleration, and therefore the value of $\rho_g$ will be taken to be constant. In the case of a relatively hard golf ball rolling on a compliant green, the value of $\rho_g$ would be expected to be primarily determined by the firmness of the green and the condition of the grass surface. In golf, one refers to the speed of the green, with a fast green being one where the ball rolls a relatively long distance before corning to rest. The speed of a green will be directly related to the deceleration of the golf ball and will, therefore, be a measure of the value of $\rho_g$. The speed of a green is typically measured by a device called a stimpmeter, which is an inclined plane with a V-groove running down its center. Experiments have shown that the initial speed of a golf ball when it leaves the end of a stimpmeter is 1.83 m/s. For what would be considered a very fast green the ball rolls, after leaving the end of the stimpmeter, a distance of approximately 12 ft (3.66 m). For what would be considered a very slow green the ball rolls a distance of only approximately 4 ft (1.22 m). Using the speed of the golf ball as it leaves the stimpmeter, the above extreme roll distances, and the acceleration of the golf ball as given by the equation (5) above, the range of values for $\rho_g$ with golf greens can be found. The result is that for golf balls rolling on golf greens $0.065<\rho_g<0.196$, with an average value of 0.131.

The physics associated with putting a ball on a sloped surface differ from the above. Additional physics and mechanics information is located in Appendix A of this application.

While the disclosure has been described in connection with the various embodiments of the various figures, it will be appreciated by those skilled in the art that changes could be made to the embodiments described above without departing from the broad inventive concept thereof. It is understood, therefore, that this disclosure is not limited to the particular embodiments disclosed, and it is intended to cover modifications within the spirit and scope of the present disclosure as defined by the claims.

Features of the disclosure that are described above in the context of separate embodiments may be provided in combination in a single embodiment. Conversely, various features of the disclosure that are described in the context of a single embodiment may also be provided separately or in any sub-combination. Finally, while an embodiment may be described as part of a series of steps or part of a more general structure, each said step may also be considered an independent embodiment in itself, combinable with others.

Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context.

What is claimed:

1. A golf putter for putting a golf ball on a putting green, the golf putter having a golf putter head, the golf putter head, comprising:

a body having an external surface, an internal surface, and a cavity defined by the internal surface, the external surface having a front side configured to contact a golf ball and a top side configured to receive a shaft; and an insert configured to be disposed within the cavity of the body, the insert having a first material and a shock absorbing element at least partially encapsulated within the first material, the first material comprising an elastomer, and the shock absorbing element having a magnet, wherein the front side forms a loft angle of 10 degrees or less measured from vertical relative to the putting green, wherein the shock absorbing element includes neodymium.

2. The golf putter head of claim 1, wherein the first material comprises polyvinyl siloxane.

3. The golf putter head of claim 1, wherein the insert includes a plurality of spherical shock absorbing elements.

4. The golf putter head of claim 3, wherein each shock absorbing element of the plurality of shock absorbing elements contacts at least one other adjacent shock absorbing element.

5. The golf putter head of claim 3, wherein the plurality of shock absorbing elements is organized such that all of the shock absorbing elements lie on the same linear axis.

6. The golf putter head of claim 1, wherein the shock absorbing element has a diameter of from about 0.05 inches to about 2 inches.

7. The golf putter head of claim 6, wherein the shock absorbing element has a diameter of from about 0.1 inches to about 1 inches.

8. The golf putter head of claim 7, wherein the shock absorbing element has a diameter of about 0.25 inches.

9. The golf putter head of claim 1, wherein the body includes an opening on the top side, the opening extending through the body and into the cavity, such that the cavity is in fluid communication with the external surface of the body.

10. The golf putter head of claim 1, wherein the body includes an opening on the front side, the opening extending through the body and into the cavity, such that the cavity is in fluid communication with the external surface of the body.

11. The golf putter head of claim 1, wherein the golf putter head is configured to contact a ball during a putting motion, such that a rolling motion is imparted on the ball and a skidding motion is inhibited.

12. The golf putter head of claim 1, wherein the front side forms a loft angle of 4 degrees measured from vertical relative to the putting green.

13. A golf putter for putting a golf ball on a putting green, the golf putter comprising:

a body having an external surface, an internal surface, and a receptacle configured to receive and fixedly secure a shaft, the external surface further having a striking surface configured to contact the ball;

a cavity defined by the internal surface, the cavity having an opening extending through the body to the external surface, such that the opening is defined by the internal surface and the external surface;

a first material having an epoxy disposed within the cavity;

a second material including a magnet, the second material being disposed within the cavity and at least partially within the first material; and a cover configured to sealably engage the body such that the opening in the cavity is closed, wherein the striking surface forms a loft angle of 10 degrees or less measured from vertical relative to the putting green, wherein the second material includes neodymium.

14. The golf putter of claim 13, wherein the second material includes a plurality of spheroid units, each spheroid unit being generally the same size and shape as any other spheroid unit.

15. The golf putter of claim 14, wherein each spheroid unit of the plurality of spheroid units contacts at least one other spheroid unit.

16. The golf putter of claim 14, wherein the spheroid unit has an average diameter of from about 0.1 inches to about 1 inches.

17. The golf putter of claim 16, wherein the spheroid unit has an average diameter of about 0.25 inches.

18. The golf putter of claim 13, further comprising a third material disposed within the cavity and at least partially adjacent the first material and the second material.

19. The golf putter of claim 13, further comprising a shaft having a proximal end and a distal end, the distal end having a handle, and the proximal end being configured to engage with the receptacle on the body.

20. A method of manufacturing a golf putter head for putting a golf ball on a putting green, the method comprising:

positioning a golf putter head body having a cavity therein such that at least a portion of the cavity is open and extends through the golf putter head body;

introducing into the cavity a first material;

introducing into the cavity a second material that is different from the first material, the second material having a magnetic element, such that the first material at least partially surrounds the second material; and sealing the cavity such that the first material and the second material are secured within the cavity, wherein the golf putter head body includes a striking surface configured to contact a golf ball during a putt, the striking surface having a loft angle of 10 degrees or less measured from vertical relative to the putting green, wherein the second material includes neodymium.

* * * * *